US007083515B2

(12) United States Patent
Rapisarda et al.

(10) Patent No.: US 7,083,515 B2
(45) Date of Patent: Aug. 1, 2006

(54) CLEAN ROOM FACILITY AND CONSTRUCTION METHOD

(75) Inventors: Joseph R. Rapisarda, Chandler, AZ (US); Timothy Colley, Tempe, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 213 days.

(21) Appl. No.: 09/975,600

(22) Filed: Oct. 11, 2001

(65) Prior Publication Data

US 2002/0174608 A1 Nov. 28, 2002

Related U.S. Application Data

(63) Continuation-in-part of application No. 09/391,113, filed on Sep. 7, 1999, now Pat. No. 6,574,937.

(51) Int. Cl.

| | |
|---|---|
| ***E04B 5/43*** | (2006.01) |
| ***E04H 5/02*** | (2006.01) |
| ***E04H 9/02*** | (2006.01) |
| ***F24F 7/00*** | (2006.01) |
| ***F24F 13/08*** | (2006.01) |

(52) U.S. Cl. ..... 454/187; 52/167.1; 52/220.8; 52/263; 52/302.1; 52/405.1

(58) Field of Classification Search ..... 454/187; 52/220.8, 236.5, 251, 252, 263, 294, 299, 52/302.1, 630, 309.12, 309.17, 405.1, 167.1
See application file for complete search history.

(56) References Cited

U.S. PATENT DOCUMENTS 667,871 A * 2/1901 Ellinger ..... 52/250
1,039,895 A * 10/1912 Burk ..... 52/252
1,353,373 A * 9/1920 Allbright ..... 52/252
3,158,457 A * 11/1964 Whitfield ..... 55/472
3,184,893 A * 5/1965 Booth ..... 52/741.15
3,367,257 A * 2/1968 Raider et al. ..... 454/187
3,456,804 A * 7/1969 McGivern ..... 210/292
4,295,810 A * 10/1981 Dennert et al. ..... 425/110
4,333,285 A * 6/1982 Koizumi et al. ..... 52/252
4,608,066 A * 8/1986 Cadwell, Jr. ..... 55/385.1
4,625,484 A * 12/1986 Oboler ..... 52/251
4,699,640 A * 10/1987 Suzuki et al. ..... 55/385.2
4,770,643 A * 9/1988 Castellani et al. ..... 439/135
4,860,506 A * 8/1989 Yoshimi et al. ..... 52/144
4,904,153 A * 2/1990 Iwasawa et al. ..... 414/735
4,923,352 A * 5/1990 Tamura et al. ..... 414/225.01
4,925,556 A * 5/1990 Gaudin et al. ..... 210/293
4,942,707 A * 7/1990 Huettemann ..... 52/259
5,349,798 A * 9/1994 Gross ..... 52/405.1
5,477,649 A * 12/1995 Bessert ..... 52/263
5,518,451 A * 5/1996 Renz et al. ..... 454/187
5,746,037 A * 5/1998 Nordberg ..... 52/405.1

(Continued)

FOREIGN PATENT DOCUMENTS

FR 944931 * 4/1949

(Continued)

*Primary Examiner*—Robert Canfield
(74) *Attorney, Agent, or Firm*—Snell & Wilmer L.L.P.

(57) ABSTRACT

A vibration-inhibiting flooring structure for use in a facility housing vibration sensitive equipment includes a perforated bearing floor which includes a number of openings configured to inhibit the propagation of vibrations across the floor. Such a flooring structure may be used, for example, in connection with advanced clean-room facilities, where a facilities room and one or more plenums are provided in conjunction with the vibration-inhibiting floor.

19 Claims, 20 Drawing Sheets

U.S. PATENT DOCUMENTS

| | | | | |
|---|---|---|---|---|
| 6,155,013 | A * | 12/2000 | Kim | 52/263 |
| 6,182,413 | B1 * | 2/2001 | Magnusson | 52/589.1 |
| 6,202,374 | B1 * | 3/2001 | Cooper et al. | 52/220.3 |
| 6,385,930 | B1 * | 5/2002 | Broms et al. | 52/251 |
| 6,574,937 | B1 * | 6/2003 | Rapisarda et al. | 52/630 |
| 6,612,084 | B1 * | 9/2003 | Rapisarda et al. | 52/630 |
| 6,615,469 | B1 * | 9/2003 | Burcham | 29/401.1 |
| 6,625,943 | B1 * | 9/2003 | Renner | 52/251 |
| 2002/0108334 | A1 * | 8/2002 | Rapisarda et al. | 52/302.1 |
| 2003/0207664 | A1 * | 11/2003 | Quinet | 454/187 |

FOREIGN PATENT DOCUMENTS

| | | | |
|---|---|---|---|
| GB | 386176 | * | 1/1933 |
| GB | 1038881 | * | 2/1963 |
| GB | 2 198 413 A | * | 6/1988 |
| JP | 6-146428 | * | 5/1994 |
| JP | 8-303051 | * | 11/1996 |
| JP | 9-893328 | * | 4/1997 |
| JP | 9-222248 | * | 8/1997 |
| WO | WO 01/18323 A1 | * | 3/2001 |
| WO | WO 03/031743 A1 | * | 4/2003 |

* cited by examiner

CLEAN ROOM FACILITY AND CONSTRUCTION METHOD

CROSS-REFERENCE TO RELATED APPLICATIONS

This is a continuation-in-part of U.S. application Ser. No. 09/391,113, filed Sep. 7, 1999 now U.S. Pat. No. 6,574,937.

BACKGROUND OF THE INVENTION

This invention relates generally to an improved clean room facility and to a novel method for constructing the clean room facility, and more specifically to an improved floor configuration for a clean room.

Clean rooms are used extensively in the electronics industry and in other industries in which a clean, substantially particle free environment is necessary during the design, fabrication, assembly, or testing of a product. Clean rooms are rated by the number of particles of a given standard size that are detected in a standard volume within the clean room. According to this rating system a "Class 10" clean room has only one-tenth the particle count of a "Class 100" clean room. Similarly, a "Class 1" clean room has only one-tenth the particle count of a "Class 10" clean room. The low particle count in a clean room is achieved by a large number of distributed air changes in the room. Air flows through the room, usually in a laminar fashion and usually downwardly from the ceiling to the floor or to vents located near the floor. The air changes wash the particulate matter from the room. Other things being equal, the greater the number of air changes, the lower the particle count in the room. For example, a "Class 1" clean room usually requires on the order of 450 or more air changes per hour.

Typically the air in a clean room enters the room through filters or vents located in the ceiling, passes through the room, washing over the contents of the room, and exits the room through openings or vents in a raised clean room floor to a plenum formed between the raised floor and the underlying structural floor of the building. The air is then recirculated and again passes through the ceiling filters and into the room.

Prior art clean rooms use a raised clean room floor. The raised and usually perforated clean room floor is supported on a pedestal or plurality of pedestals. The pedestals are usually specially constructed structures designed specifically for the equipment that is to be placed on the raised floor. The raised floor itself is usually inadequate to support the weight of the equipment. The necessary pedestal structures are often very expensive, sometimes having a cost equaling a large percentage of the total equipment cost.

Presently known clean rooms also utilize the raised floor to form the return air plenum and to provide facilities to the equipment. For example, power lines, chemical lines, exhausts, drains, and the like typically pass through the raised floor and extend under the raised floor to a facilities area.

In addition to the expense of the customized pedestals used to support a raised clean room floor, there are a number of other significant drawbacks to a raised floor configuration. Because the raised floor, by itself, is unable to support the weight of equipment that might be placed in the clean room, the raised floor also cannot support the weight of that equipment as it is being moved within the clean room. This results in the necessity for disassembling the raised floor when equipment is moved into a clean room or is moved about the clean room. The floor is disassembled, equipment is moved within the clean room, placed on the portion of the raised floor in substantially its final location, and then the remaining portion of the raised floor is reassembled. This activity compromises the cleanliness of the clean room every time a piece of equipment is moved into, out of, or about the clean room. In addition, any facilities lines that may be located under the portion of the raised floor that is removed will also be disturbed by the moving of equipment. Because of these difficulties, it is commonplace to build relatively small or compartmentalized clean rooms so that only a small area is contaminated by any moving process. This, of course, leads to disadvantages in terms of material flow because materials being processed must be moved into and out of these individual compartmentalized clean rooms.

Much of the processing that is done in the clean room requires a substantially vibration free environment as well as a particle free environment. The use of raised clean room floors is also thought by many to suppress vibrations caused by the equipment located in the clean room. Although the raised floor and the platform upon which the raised floor is supported may dampen vibrations propagated by the underlying structural floor, the underlying slab floors found in known clean rooms nonetheless tend to be a conduit for vibration.

Many industries require substantially vibration free operating environments in which to house vibration-sensitive instruments and tools, such as those used by the microelectronics, medical, optical, biopharmaceutical, and other high-technology sectors. In the semiconductor industry, for example, the use of increasingly smaller microelectronic structures, including line widths on the order of 0.1 microns, has resulted in a need for higher levels of vibration isolation for vibration-sensitive tools. In this regard, equipment manufacturers are increasingly incorporating vibration isolation technology into their instruments and tools in an attempt to address the vibration isolation problem.

The problem of vibration isolation is complicated by the fact that it is often difficult to identify with certainty and to prioritize the factors that impart vibration to vibration-sensitive equipment. For example, it has been observed that equipment operating in other buildings, automobile traffic in the vicinity of a manufacturing or measurement facility, and even people walking in adjacent rooms or adjacent floors in a building can influence the vibration profile within a vibration-sensitive environment such as a semiconductor fabrication facility. Moreover, the design of a building or other structure, the materials used during construction, and other architectural and structural factors also influence the extent to which vibrations may be dampened or even amplified in the context of a vibration-isolation environment.

In an attempt to quantify standards for acceptable levels of vibration isolation in various environments, generic vibration criterion (VC) curves have emerged as a useful analytical tool. For more background regarding such generic vibration criterion, see, e.g., Institute of Environmental Sciences, "Considerations in Clean Room Design," IES-RP-CC012.1 (1993), hereby incorporated by reference. With momentary reference to FIG. 7, the vibration sensitivity of a facility, for example a clean room, may be determined by plotting vibration data for the facility on a VC Curve set. For example, an accelerometer may be used to detect vibration information (expressed as velocity data in FIG. 7) for a range of frequencies of interest. By analyzing the plotted vibration data against the backdrop of a family of predetermined standard VC Curves such as those shown in FIG. 7, that facility may be classified in terms of its vibration isolation profile. By way of brief example, if all of the data taken and plotted for a particular facility is bounded by the VC-A curve shown in FIG. 7, the facility may be deemed adequate for housing tools such as microbalances, optical balances, and other equipment with a relatively low degree of vibration sensitivity. If, on the other hand, all of the data for a particular facility is bounded by the VC-D curve, then that facility may be deemed suitable for the most demanding equipment including semiconductor fabrication equipment operating in the 0.3 micron line width regime. See, Colin G. Gordon, *Generic Vibration Criteria for Vibration-Sensitive Equipment*, International Society for Optical Engineering (SPIE) Conference on Current Developments in Vibration Control for Optomechanical Systems, Denver, Colo. (July 1999), the entire contents of which are hereby incorporated by this reference.

Inasmuch as concrete slab and other known floor configurations contribute to the problem of vibration isolation, a new floor configuration for use with vibration-sensitive equipment is thus needed which overcomes the shortcomings associated with known floor configurations.

In view of these and other problems with conventional clean room designs, it has been recognized that a need exists for a clean room that is less expensive to build and to operate than a raised floor clean room. There is also a need for a clean room that allows for non-intrusive clean room practices for facilitizing equipment located in the clean room. The need also exists for a clean room that does not require an expensive and customized pedestal for equipment, but rather allows the placement of equipment anywhere within a clean room. There is also a need for a clean room into which equipment can be moved and relocated without compromising the integrity of the clean room. A need also exists for a clean room that can be large in area and conveniently expandable in area.

There is also a need for a floor configuration for use with vibration-sensitive equipment which dampens vibrations to, from and among the vibration-sensitive equipment.

BRIEF SUMMARY OF THE INVENTION

In accordance with one embodiment of the invention, a clean room is provided having a bearing floor capable of supporting equipment in any location thereon. The bearing floor is positioned over a facilities room which, in effect, is an extension of the clean room. The bearing floor has a regular array of openings through the floor which permit air to flow from the clean room into the underlying facilities room. A wall structure is positioned on the bearing floor to surround a selected area of the bearing floor. A ceiling having a plurality of filtered air inlets is provided above the bearing floor and in contact with the top of the wall structure. A plurality of grates are positioned in those floor openings of the regular array that are located within the selected area bounded by the walls and solid, air impervious members are positioned in those floor openings of the regular array that are located outside the selected area. By substituting air impervious members for grates, or vice versa, the area of the clean room can be expanded or reduced. Preferably the location and number of filtered air inlets is also adjusted to correspond to the number of grated openings in the clean room floor.

In accordance with the further aspect of the invention, a floor configuration is provided which significantly reduces the transmission of vibrations to, from, and among vibration-sensitive equipment disposed on the floor. Indeed, although the vibration dampening floor configurations of the present invention are disclosed herein in the context of a clean room, such floor configurations may be utilized in any environment where vibration isolation is desired.

DETAILED DESCRIPTION OF PREFERRED EMBODIMENTS

Figure 1:
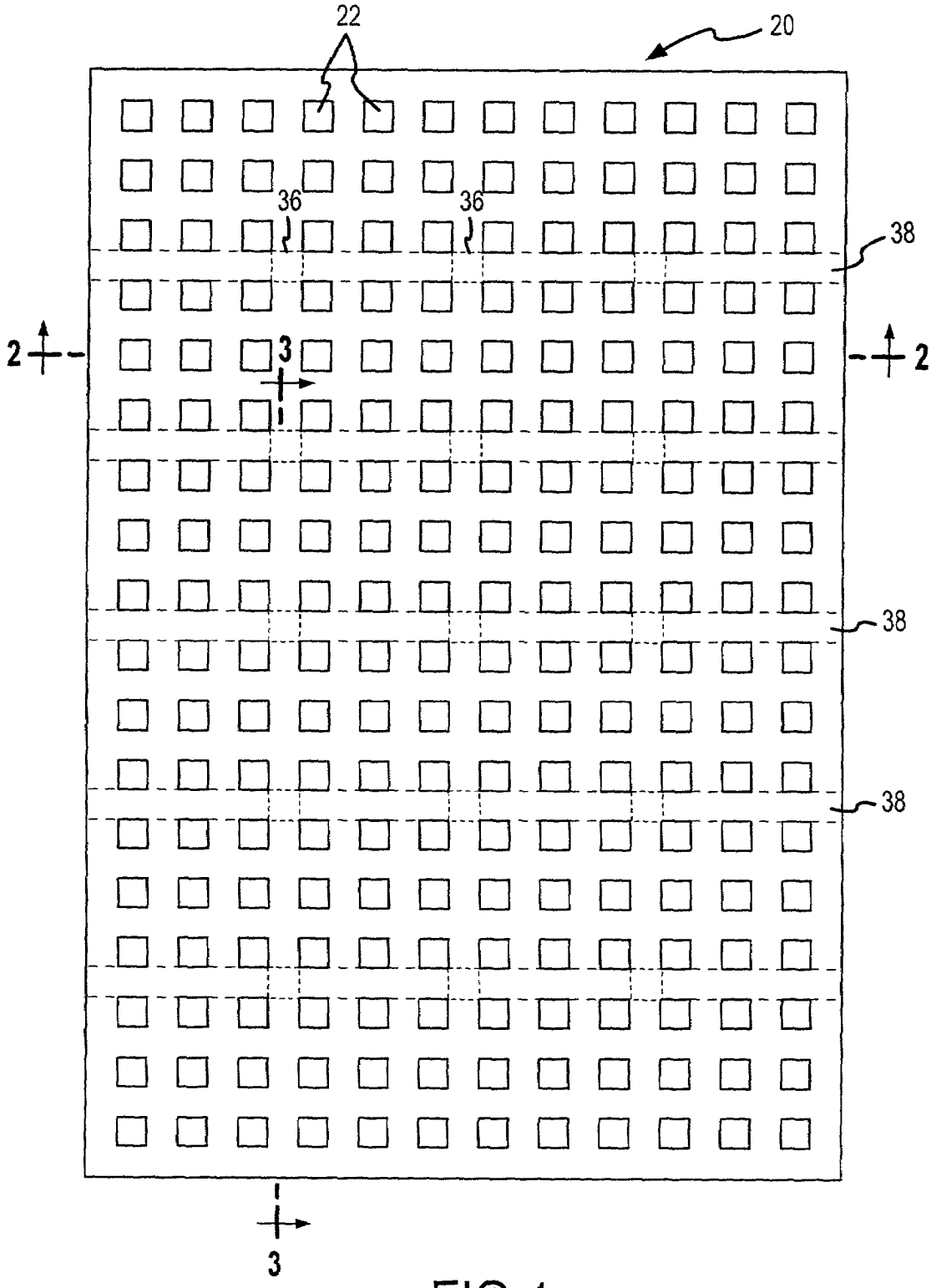
FIG. 1 illustrates, in plan view, a perforated clean room floor in accordance with one embodiment of the invention.
Figure 2:
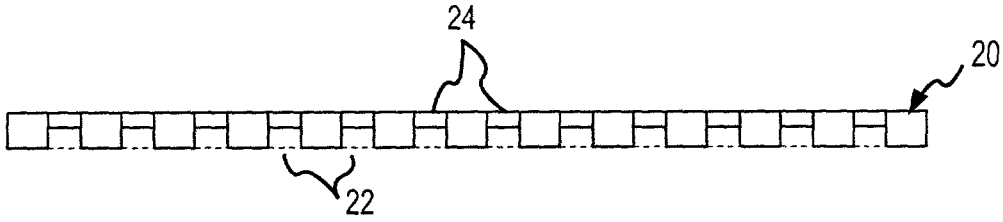
FIG. 2 illustrates, in cross-section, a clean room floor in accordance with the invention.

FIG. 1 illustrates, in plan view, a floor 20 for a clean room in accordance with one embodiment of the invention. FIG. 2 illustrates a cross-section taken through the floor 20, as indicated, and FIG. 3 illustrates a further cross-section through floor 20 and the substructure, as indicated.

Figure 3:
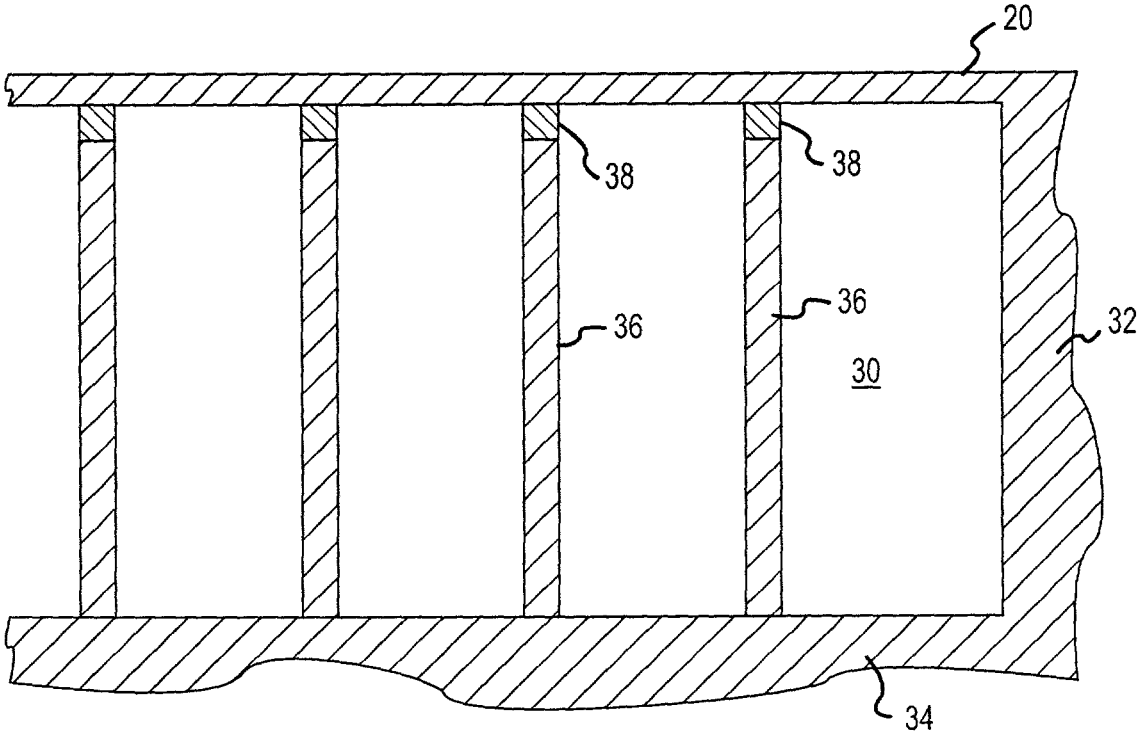
FIG. 3 illustrates, in cross-section, a portion of a clean room facility.

In accordance with one embodiment of the invention, as illustrated in FIGS. 1–3, the floor 20 is a poured-in-place concrete floor having a plurality of openings 22 extending through the thickness of the floor. The plurality of openings 22 are preferably arranged in a regular array. The openings can be, for example, square openings, rectangular openings, circles, ovals, ellipsis, triangles, trapezoids, parallelograms, random shapes, a combination thereof, or any other convenient form. In the context of the present invention, the openings serve a number of different functions, including one or more of the following: (i) providing a path for airflow from the clean room into an air plenum to reduce particle count; (ii) providing convenient local facilities access from the facilities room to various locations within the clean room; and (iii) creating discrete discontinuity in the floor which supports the vibration-sensitive equipment, thereby disrupting the propagation path of undesired vibrations, resulting in substantial mitigation of vibrations which might otherwise deleteriously affect the vibration-sensitive equipment mounted on the floor.

In the embodiment illustrated in FIGS. 1–3, the openings are in a. regular, repeating array (although virtually any pattern of openings which satisfies one or more of the foregoing performance objectives may be employed). For the illustrated regular rectangular array of openings, each opening suitably exhibits a side dimension in the range of six inches to four feet, with a spacing in the range of six inches to four feet. In a particularly preferred embodiment, the square openings have side dimensions in the range of two feet with a spacing of two feet between openings.

As will be explained below, some of the openings have an associated cover 24 inserted therein with the top of the cover disposed in a substantially co-planar alignment with the top of the solid floor. The cover consists of either an air permeable cover (such as a grate) or an air impermeable cover, depending upon the location of the opening within the clean room facility.

Floor 20 is suitably constructed overlying at least a portion of a room 30. In the illustrated embodiment, room 30 is a below grade basement. Room 30 can be advantageously used to house facilities used by the equipment employed in the clean room. Accordingly, room 30 will be referred to herein as a facility or facilities room. In the illustrated embodiment room 30 includes, as illustrated in FIG. 3, one or more bearing side walls 32 and a supporting floor 34, for example a concrete slab floor. A plurality of support pillars 36 extend upwardly through or from the concrete slab floor 34. In accordance with one aspect of the invention, floor 20 is supported by columns 36, and in the particular embodiment shown in FIG. 3, a plurality of beams 38 span the facility room 30 and are supported by the plurality of columns 36. The support beams 38, in turn, support the perforated clean room floor 20. Alternatively and as described in greater detail below, floor 20 may be disposed directly upon the top surfaces of some or all of respective columns 36. The facility room floor 34, walls 32, support pillars 36, and floor 20 are preferably constructed of reinforced concrete incorporating, for example, reinforcing steel bars (rebar), such as rebar manufactured in accordance with ASTM standards A615, A616, A617 and/or A706. The composition of the concrete and the size and amount (if any) of rebar used for reinforcing may be determined in accordance with known structural calculations to support the weight of the equipment intended to be used in the clean room. Sound engineering practice, of course, dictates that the structure be over-designed to support a weight much greater than that actually intended to be used in the clean room.

Figure 4:
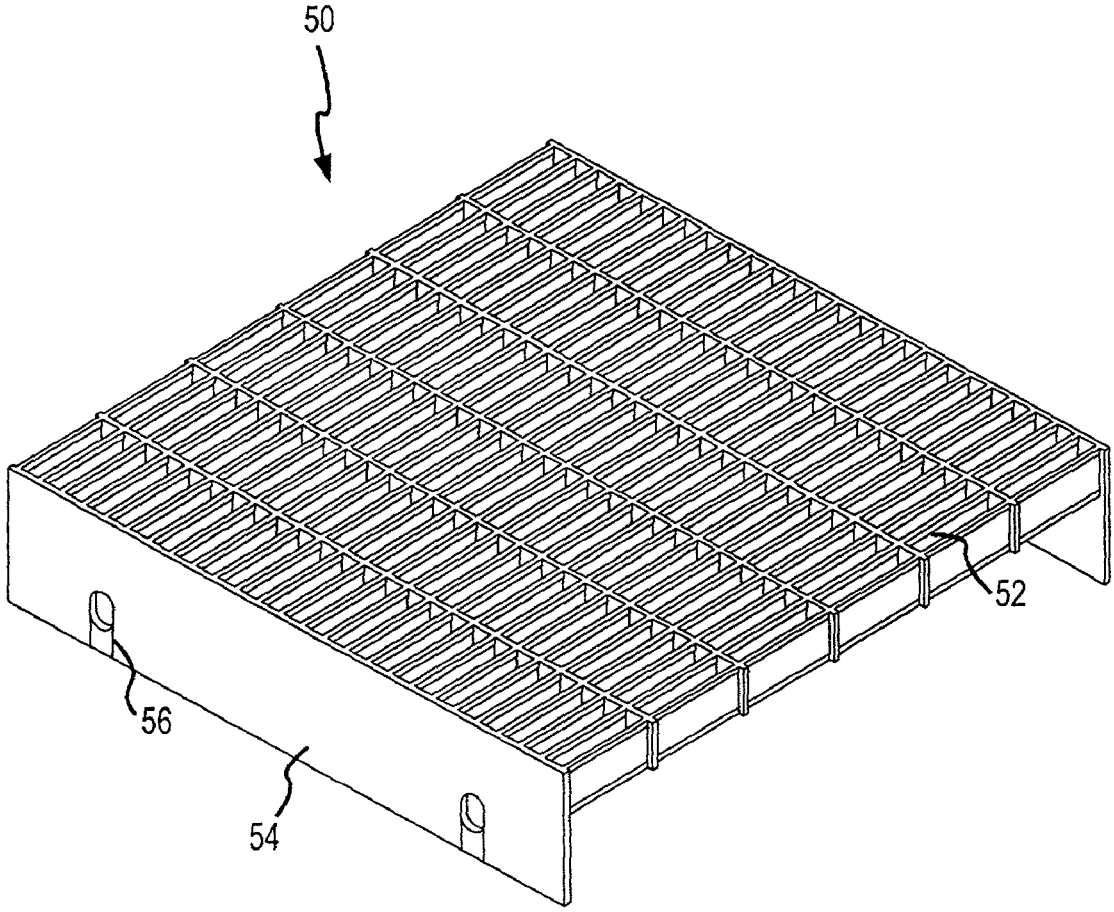
FIGS. 4 and 5 illustrate a grate and its method for installation in a perforated floor in accordance with one embodiment of the invention.
Figure 5:
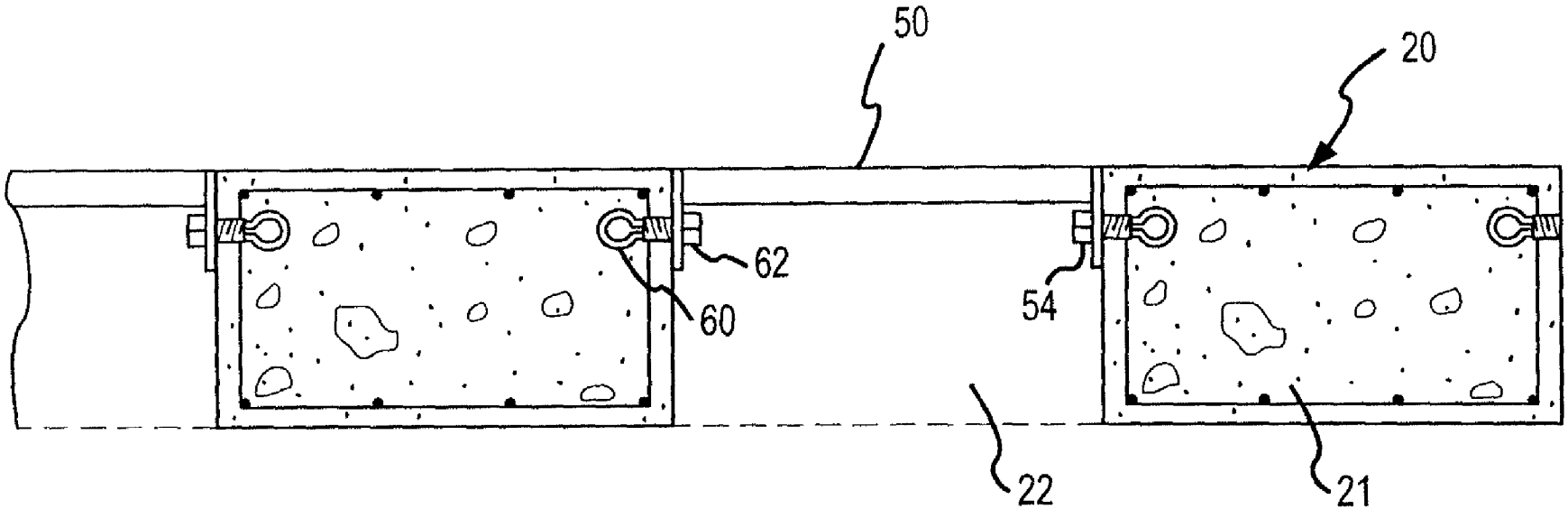

A preferred grate structure 50 to be used as one of the covers 24 inserted in an opening 22 in a clean room floor is illustrated in FIG. 4. FIG. 5 illustrates how that grate is held in place within the floor 20. Grate 50 includes a mesh top 52 and an apron 54 extending downwardly from at least two of the sides of the mesh top. Slots 56 are provided in the apron to allow adjustable attachment of the grate within opening 22 as will be explained below. The grates can be made of any suitable, structurally sound material. Preferably the grates are made of a metal such as stainless steel. The mesh top is designed to provide the free flow of air therethrough and simultaneously to provide structural strength. In accordance with one embodiment of the invention, the mesh top is fabricated from stainless steel and has openings of about 1 inch by 4 inches. The mesh top can be about 1½–2 inches in height and the apron is preferably about 4–5 inches in height.

Although not illustrated in any of the figures, one further embodiment of the invention includes the incorporation of adjustable louvers in the metal grates 50. Such adjustable louvers allow for adjusting the air flow through the clean room facility.

FIG. 5, which illustrates a portion of floor 20 in cross-section, depicts a preferred method for attaching the grates within the openings 22. During the pouring of concrete floor 20, ferrule loops 60 are embedded in the solid portion 21 of floor 20. Preferably four ferrule loops are embedded in the walls of each of the openings 22, two each on opposing sides of the opening. The ferrule loops are positioned to align with slots 56 in the grates. A ferrule loop is used because the loop portion provides a good anchoring mechanism within the concrete material. The end of the ferrule loop extending out from the concrete is threaded to receive a bolt 62. The grate is placed in the opening so that the slots 56 in apron 54 are positioned over the threaded ends of ferrule loops 60. Bolts 62 are threaded onto the ferrule loops, the height of the grate is adjusted to be substantially co-planar with the surface of the concrete 21, and the bolts are tightened to hold the aprons and therefore, the grates securely in this aligned position.

Figure 6:
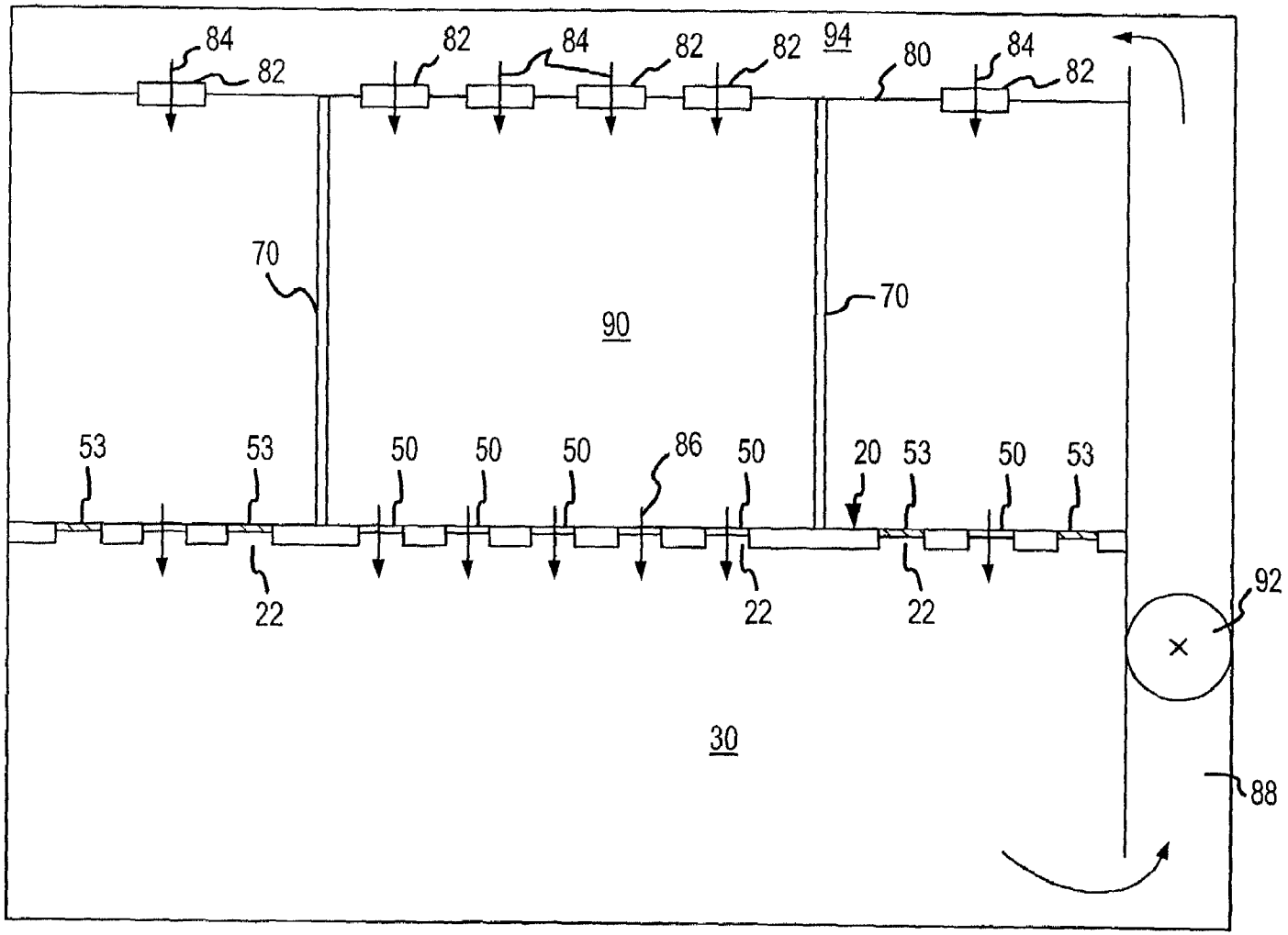
FIG. 6 illustrates schematically, in cross-section, a clean room facility in accordance with the invention.
Figure 7:
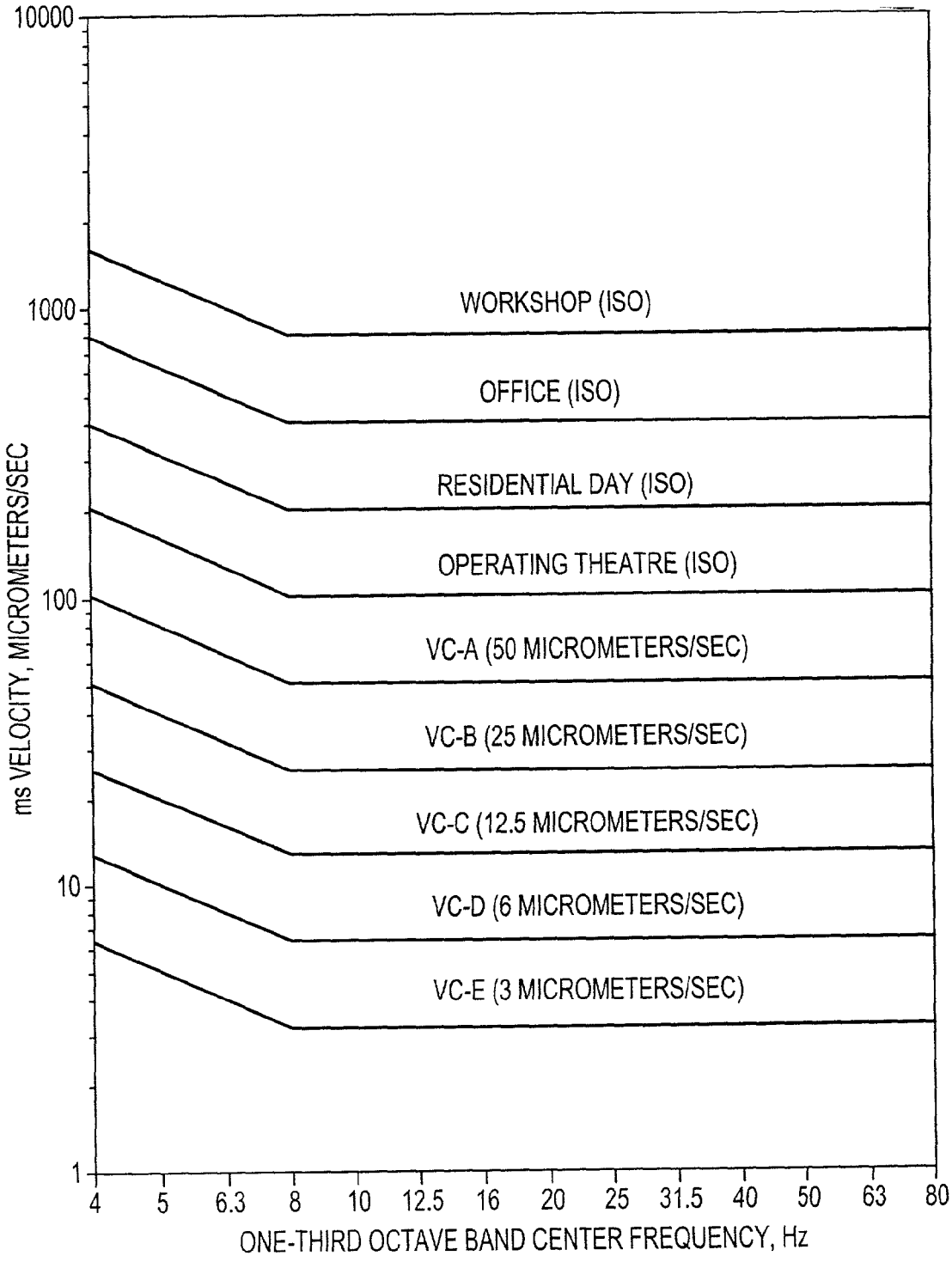
FIG. 7 is a graph of a family of standard VC Curves.

One embodiment of a clean room facility in accordance with the invention is further illustrated schematically in FIG. 6. In this illustration the clean room facility is illustrated along a vertical cross-section. The clean room facility includes facility room 30 as previously described. Overlying the facility room is a perforated floor 20. Vertical walls 70 surround an area of the perforated floor 20. The area of the perforated floor surrounded by walls 70 may encompass all of the perforated floor or, alternatively, a portion of the floor, leaving a second portion of the floor external to the walls 70. A ceiling 80 overlies perforated floor 20 including the portion of the perforated floor that is enclosed by walls 70. In a preferred embodiment, an airtight seal is made between the walls 70 and the ceiling 80 and also between the walls 70 and the perforated floor 20. Walls 70, a portion of ceiling 80, and a portion of perforated floor 20 thus enclose a volume constituting the clean room 90. Ceiling 80 includes a plurality of filtered air inlets 82. The filtered air inlets 82 have a greater density over the clean room 90 than they do over the area outside walls 70. In addition, the openings 22 which extend through floor 20 and which are located within the area bounded by walls 70 are covered by grates 50. The majority of the openings 22 through the floor 20 which are located outside the clean room 90 are covered by an area impervious cover 53.

Air circulation through the clean room facility is also shown in the embodiment illustrated in FIG. 6. Air enters clean room 90 through the filtered air inlets 82 as illustrated by arrows 84. The filtered air passes through clean room 90 and is exhausted into facility room 30 through the openings 22 in perforated floor 20 as illustrated by the arrows 86. Air is then exhausted from facility room 30 through an air plenum 88. A blower 92 conveys the air to a further plenum 94 which overlies ceiling 80. The air is then again filtered and forced through filtered air inlets 82. In this manner repeated air changes within clean room 90 "wash" particulate matter from the clean room. The number of air changes in clean room 90 is a function of the speed with which the air is circulated by blower 92, by the number of air inlets 82, and by the number of openings 22 through which the air can be exhausted into facility room 30. Because of the lower density of filtered air inlets in the region outside of walls 70 and because of the smaller number of openings 22 through which air can be exhausted, the particle count outside of clean room 90 will be greater than the particle count within the clean room.

The concept illustrated in FIG. 6 has a very important advantage over prior art clean rooms. A relatively large perforated floor 20 can be initially constructed over a relatively large facility room 30. Thereafter temporary walls 70 can be constructed on floor 20 to construct a clean room of any desired size up to and including a clean room encompassing all of floor 20. To change the size of clean room 90 requires only that the walls 70 be moved, the coverings on openings 22 be changed from air impervious to grates or vice versa, and the ceiling tiles be changed to increase or decrease the area of high density filtered air inlets.

Floor 20 is designed and constructed to be a load bearing floor. The floor is designed so that equipment can be placed directly on the perforated floor at any location within the clean room 90 regardless of the size of the clean room. Because equipment can be placed and supported anywhere on the perforated floor, equipment can be moved into and out of the clean room at will, and can be placed in any location within the clean room. Moving equipment into or about clean room 90 does not require the dismantling of a raised floor nor the assembly or moving of a costly support platform upon which the equipment must rest. Equipment can easily be moved into or out of clean room 90 on an air palette without compromising the cleanliness of the clean room. An air palette can easily move across the perforated floor by placing thin sheets of air impervious material such as thin sheets of plastic or metal (or virtually any material which will support the weight of the equipment being carried by the air palette) over the floor grates as a temporary measure while the air palette passes over the grates.

In addition, all facilities lines such as gas lines, chemical lines, power lines, and the like can be routed from the equipment through any convenient (for example, the nearest) opening 22 to the facilities room below. This is in contrast to the conventional raised floor clean room in which facilities lines are routed underneath the raised floor. Thus, in accordance with one aspect of the invention, facilities lines need not be routed across the floor and thus need not impede the movement of equipment across the floor.

One embodiment of the clean room in accordance with the invention may be constructed as follows. The facilities room 30 is first constructed in accordance with normal construction practices utilized in the building of fabrication facilities for the electronics and other similar industries. Preferably, facilities room 30 is constructed below grade and the floor and walls of the facility room are poured concrete constructed on substantial footings to minimize terrestrial vibration. Support columns 36 and beams 38 may be erected in accordance with calculations done, as described earlier, on the size and reinforcing necessary to support the intended load. When properly designed in this manner, the perforated floor to be constructed overlying the beams can be extended to virtually any size by repeating the pattern of support pillars and beams. A clean room of any desired size can thus be constructed in this manner.

After the support pillars and beams are in place, temporary forms are erected over the beams. Alternatively, the "beams" may also comprise poured concrete, such that the "beams" are integral with the concrete waffle slab, as discussed in greater detail below in connection with FIGS. 11–14. In accordance with one embodiment of the invention, the forms used to support the floor while the concrete is being poured include an array (for example a regular array) of wooden boxes having the size and shape desired for the openings in the floor. These wooden boxes can be made, for example, from plywood and are supported on or integral with the concrete forms. Alternatively, the boxes may be made from many convenient building material which will remain intact during pouring and drying of the concrete floor. Indeed, in a preferred embodiment, the material used to construct the boxes is removed and discarded once the floor is constructed.

Ferrule loops 60 are attached to the wooden boxes for the ultimate attachment of the floor grates 50. With the forms including the wooden boxes in place, and with the appropriate amount of reinforcing rods in place, the perforated concrete floor is poured to a depth substantially co-planar with the tops of the array of wooden boxes. As discussed in greater detail below in connection with FIGS. 12 and 13, a portion of the array of boxes may be constructed to be shorter in height than the remaining portion of the wooden boxes which are intended to comprise the initial clean room portion of the facility. In this way, some amount of concrete (e.g., on the order of 4 inches) will be poured on top of the "shorter" boxes, for example if it is desired to dedicate a portion of the perforated floor to uses other than as a clean room, such as toilet facilities, hallways, office space, and the like.

After the concrete has set, the wooden boxes can be broken apart and removed leaving the ferrule loops in place in the edges of the openings through the concrete floor. In one embodiment, for those areas which are not intended for immediate use as a clean room area, a temporary, air impervious cap can be placed in the openings 22. One way to form the air impervious caps, for example, is to pour about 4 inches of concrete in each of the openings that are not intended to receive a grate. Upon later expansion of the clean room, the 4 inches of concrete can easily be removed. Until so removed, however, the 4 inches of concrete is adequate to provide a safe floor upon which foot traffic and some equipment can be moved. Alternatively, temporary air impervious caps can be placed in those openings which are not initially intended to receive a grate. Temporary caps can be made from concrete, solid pieces of metal, or the like. Such caps can also be affixed to the ferrule loops.

One difficulty with solid concrete floors in a fabrication area is that vibrations tend to propagate along a concrete slab. Thus vibration generated by one piece of equipment may adversely affect the performance of an adjacent piece of equipment. It has been discovered, however, that the perforated floor in accordance with the invention does not have this problem of easy propagation of vibrations. Instead, it has been discovered that the perforated floor in accordance with the invention serves to dampen vibrations.

As discussed above, in many applications it is desirable to provide a substantially vibration free operating environment, such as a clean room, test facility, design facility, or a room used for virtually any task which requires a high degree of equipment stability. Designing such a facility can be a complicated, elusive task, because of at least the following factors: (1) it is often difficult to identify with particularity the sources of undesired vibrations; (2) the sources of undesired vibrations change during the course of a day, attributable to factors such as automobile traffic patterns, foot traffic patterns, the turning on and off of equipment such as pumps, air conditioners, both inside and outside of the room which houses the vibration sensitive equipment; (3) the structural design of the building and the materials used in constructing the building often contribute to the dampening and/or amplification of vibrations; (4) different equipment is sensitive to vibrations at different frequencies; (5) building materials and the ground underneath the building tend to "relax" over time which may exacerbate vibration propagation problems; and (6) even within the same model number of a piece of equipment from a particular vendor, the vibration sensitivity of the equipment may vary from machine to machine and may also vary over time.

In accordance with one aspect of the present invention, a substantially vibration free operating environment may be produced using what is variously referred to herein as a "waffle" or "perforated" floor. Although the vibration isolation facility shown in the drawings illustrates a floor having a regular array of square openings, the invention contemplates virtually any floor configuration which serves to disrupt or inhibit the propagation of vibration through or across the floor. In contrast to concrete slab floors, or other floors of substantially solid construction, the perforated floor of the present invention is believed to shunt, reduce, or otherwise inhibit the propagation of vibrations as a result of the perforations, while at the same time allowing a sturdy surface upon which heavy vibration-sensitive equipment may be placed, thereby avoiding the need for a raised floor above a structural subfloor. Thus, the present invention contemplates regular arrays of openings, random arrays of openings, or openings arranged in virtually any manner which serve to inhibit the propagation of vibrations across the floor. The invention contemplates openings which are square, rectangular, trapezoidal, triangular, circular, elliptical, shapes having discrete geometric changes (such as corners and angles) as well as openings having rounded, radiused, or arcuate boundaries, or any combination of the foregoing. Moreover, the "openings" of the present invention may be substantially open, such as to permit the flow of air or liquid therethrough (whether grated or not), as well as openings which may be partially or wholly filled with a material or substance which absorbs vibration energy to further mitigate the propagation of vibrations across the floor. These materials may include plastic, sponge, rubber, or any suitable monomer or polymer, either alone or in combination with a grate, sheet material or the like to support equipment, foot traffic, and the like. In accordance with one embodiment, the material is selected such that it inhibits one vibration mode over another and/or inhibits vibration propagation in one direction over another, i.e., is anisotropic. In this way, the material may be randomly or methodically inserted to further reduce vibration propagation.

Moreover, although the invention is described herein as comprising a poured concrete waffle floor, it will be appreciated that the invention is not so limited. For example, a concrete/polymer blend, an aggregate material, or indeed any combination of the foregoing, may be employed which provides sufficient structural support for the equipment to be placed on the floor. In addition, the number, size, and spacing of the columns used to support the floor may be selected as desired to adequately support the floor in a manner which minimizes the propagation of vibrations from the ground up through the columns and to the perforated floor, while at the same time maintaining a cost efficient construction methodology.

Referring now to FIGS. 8–13, an alternate method of constructing a perforated floor for use in a substantially vibration free facility will now be described.

Figure 8:
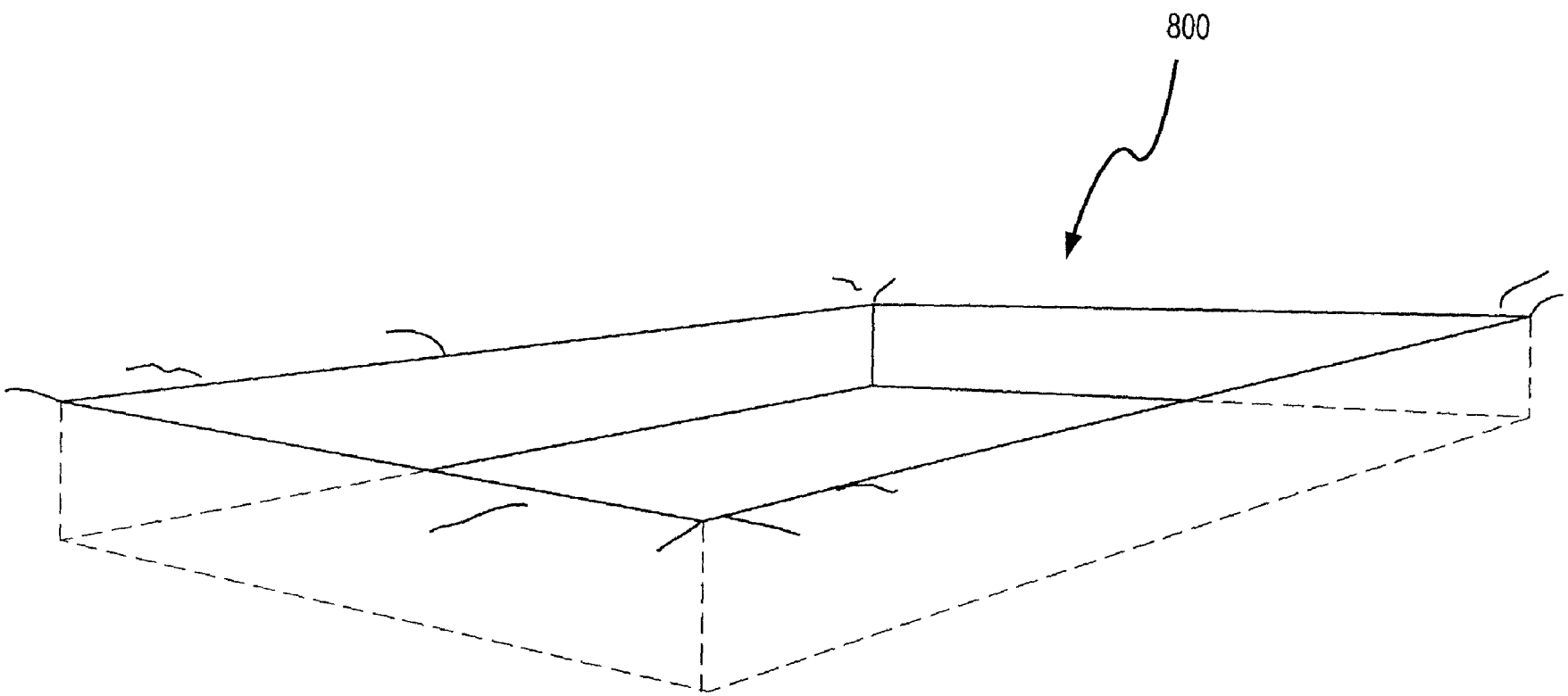
FIG. 8 is a schematic view of a below grade excavation area for use in constructing a clean room facility.

In accordance with one aspect of the present invention, at least a portion of the vibration isolation facility (also referred to herein for convenience as the "clean room") suitably has at least a portion of the facility located at ground level, or street level. Thus, in accordance with one embodiment, it may be desirable for the facilities room beneath the clean room to be constructed below grade, i.e., such that the facilities room is below ground level much like a basement. Thus, as shown in FIG. 8, a first step in constructing a clean room facility in accordance with the present invention may involve excavating a below grade area 800 which generally corresponds in shape and size to the facilities area beneath the clean room.

Figure 9:
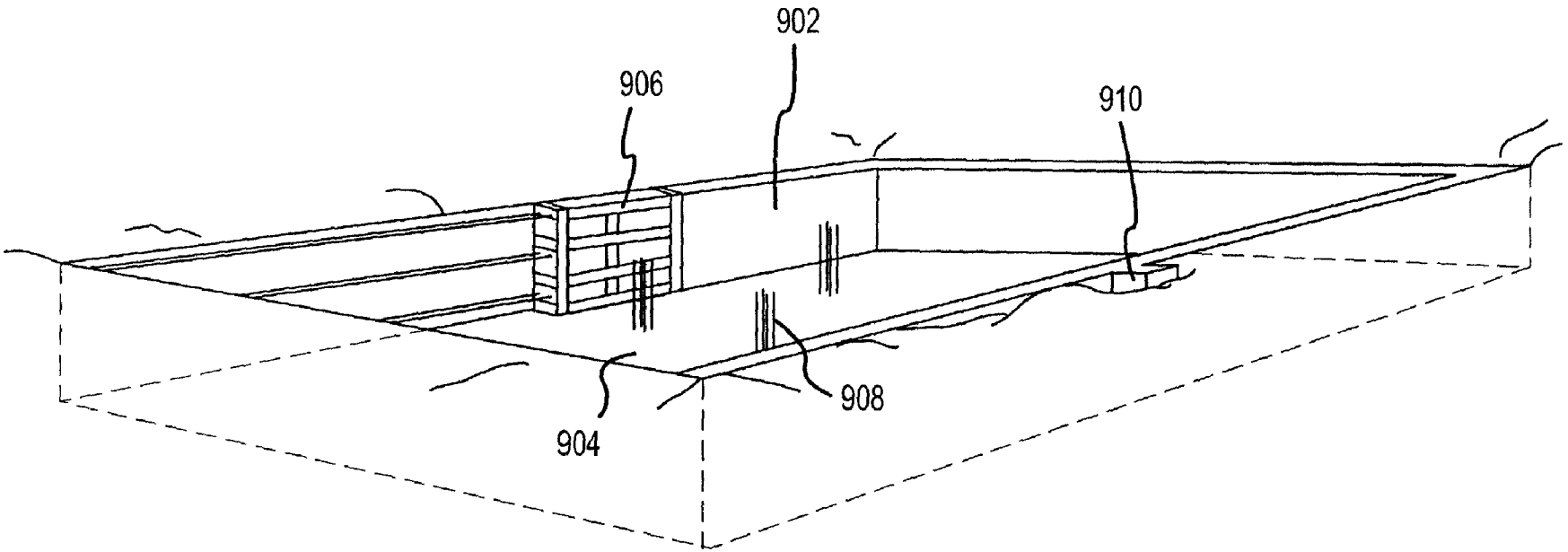
FIG. 9 is a schematic perspective view of the walls and the layout of interior columns for a facilities room.

With reference to FIG. 9, the excavated area may then be equipped with sidewalls 902 and a slab floor 904. In a preferred embodiment, walls 902 are made from steel reinforced (e.g., by using rebar) poured concrete walls made using a wall form 906. Floor 904 may also comprise a rebar reinforced poured concrete floor. In a preferred embodiment, prior to finishing floor 904, a plurality of column footings 908 are suitably constructed, as described in greater detail below in conjunction with FIGS. 16 and 18. If desired, one or more support columns 910 may be incorporated into the sidewalls 902.

Figure 10:
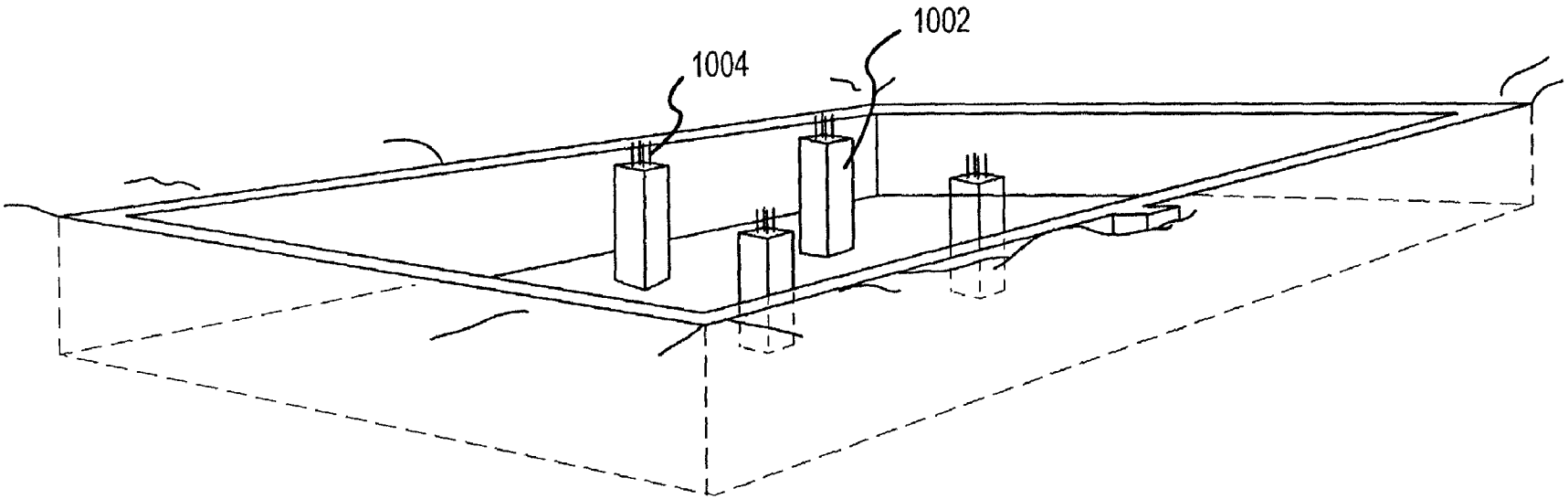
FIG. 10 is a perspective schematic view of a matrix of columns for use in supporting a waffle slab floor in accordance with the present invention.

Referring now to FIG. 10, a plurality of columns 1002 are suitably constructed on the plurality of column footings 908 (see FIG. 9). Preferably, each column 1002 as well as any columns which may be formed in the sidewall include internal rebar 1004 extending through the top of the column. As described in greater detail below, the rebar 1004 is subsequently secured to the rebar associated with the perforated floor supported by columns 1002.

With continued reference to FIG. 10, in one embodiment of the present invention, the perforated floor is supported directly on top of columns 1002, such that the concrete or other material which comprises the perforated floor is poured directly onto the top surface of each of the respective columns 1002. In order to accomplish this, the forms (typically constructed of plywood) used to define and support the bottom surface of the perforated floor must themselves be supported by something other than columns 1002. More particularly and with reference to FIG. 11, a truss structure 1102, for example comprising a plurality of scaffold structures, is temporarily erected on floor 904. Truss assembly 1102 is configured to support the form for the perforated floor. In this embodiment, the form for the perforated floor has an upper planar surface (which corresponds to the bottom surface of the floor which is poured onto the form). The top surface of this form, in the illustrated embodiment, is substantially co-planar with the top surface of columns 1002. For clarity, the actual form is not shown in FIG. 11 (the form is shown and described in FIG. 12); rather, it can be seen that the form may be conveniently laid on top of and supported by a plurality of beams 1104 which, in turn, are supported by truss assembly 1102.

Figure 11:
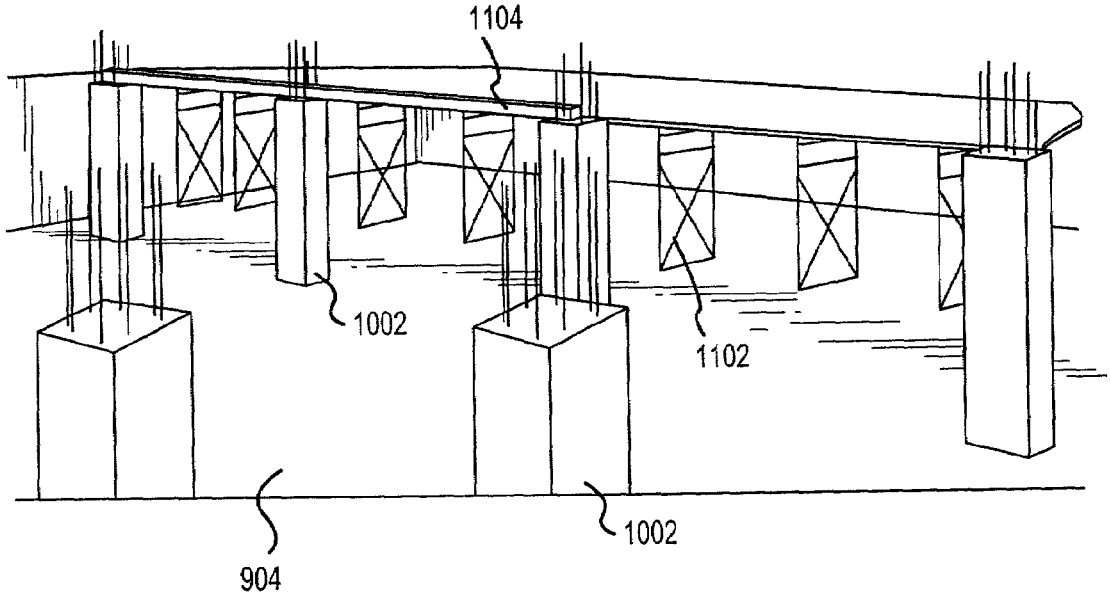
FIG. 11 is a schematic perspective illustration of a truss assembly for supporting the form used in pouring a waffle floor in accordance with one embodiment of the invention.

With continued reference to FIG. 11, the top surface (or "top side") of the form is co-planar with the top surface of respective columns 1002; thus, the form includes a series of cut outs which correspond to the cross-sections of columns 1002. In this way, the bottom surface of the resulting perforated floor will comprise a continuous plane (in the vicinity of the columns) which extends from the top surface of the form near each column, and thereafter extends across and thus integral with the top surface of respective columns 1002. After the perforated floor has been poured and dried, truss structure 1102, beams 1004, and the form used to support the poured floor are removed.

Figure 12:
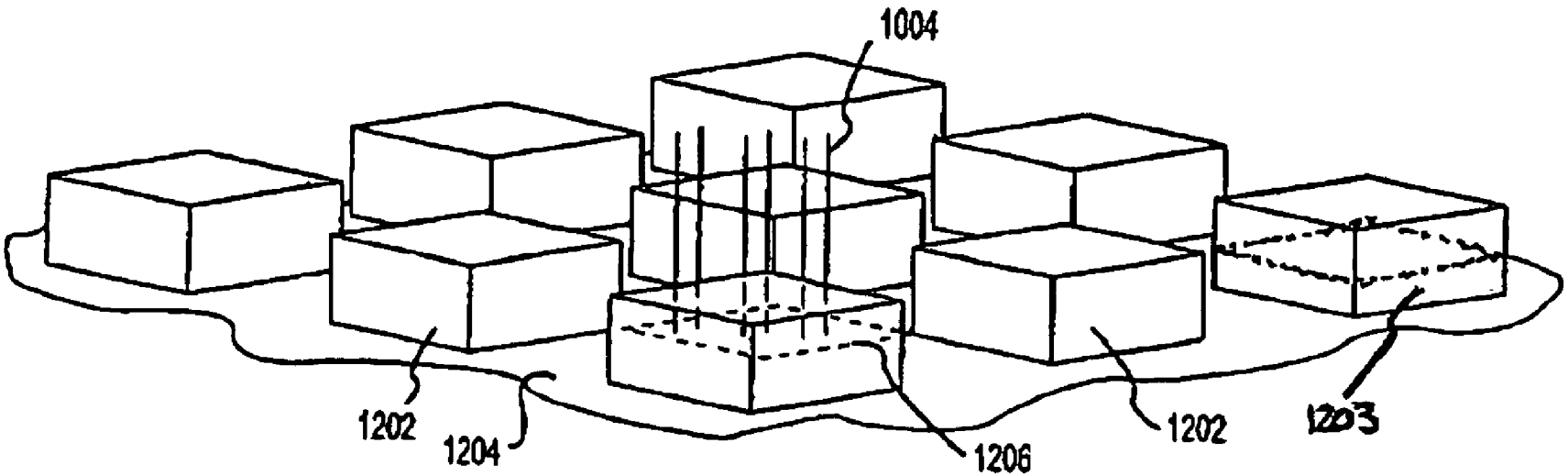
FIG. 12 is a schematic perspective view of a matrix of boxes used for forming perforations.

Referring now to FIG. 12, prior to pouring the perforated floor, a plurality of structures 1202 (in the form of boxes in the illustrated embodiment) are constructed on the top surface of form 1204. As discussed above in connection with FIG. 11, the top surface of form 1204 defines the plane of the bottom surface of the yet to be poured perforated floor. Form 1204 is supported from below by truss structure 1102 (and if desired beams 1104) as shown in FIG. 11.

With continued reference to FIG. 12, in order to provide the openings in the perforated floor described above, it is convenient to construct structural forms (or simply "structures") 1202 on the top surface of form 1204 prior to pouring the perforated floor. As also briefly mentioned above, structures 1202 may be empty if it is desired that the resulting perforations in the perforated floor take the form of openings. Alternatively, structures 1202 may be partially or completely filled with one or more substances (e.g., 1203) designed to further dampen vibrations across the perforated floor.

As also briefly discussed above in connection with FIG. 11, form 1204 exhibits a series of cut outs 1206 through which the top of each column may be seen and through which the rebar 1004 associated with each column extends. In a preferred embodiment, the top surface of form 1204 is parallel to the top surface of each of the columns so that the resulting poured perforated floor is supported by the various columns. Alternatively, the top surface of form 1204 may be disposed below the top surface of each of the columns, for example on the order of ¼ to 6 inches. In this way, the resulting perforated floor is still supported by the columns, but the columns penetrate into the bottom of the perforated floor.

Figure 13:
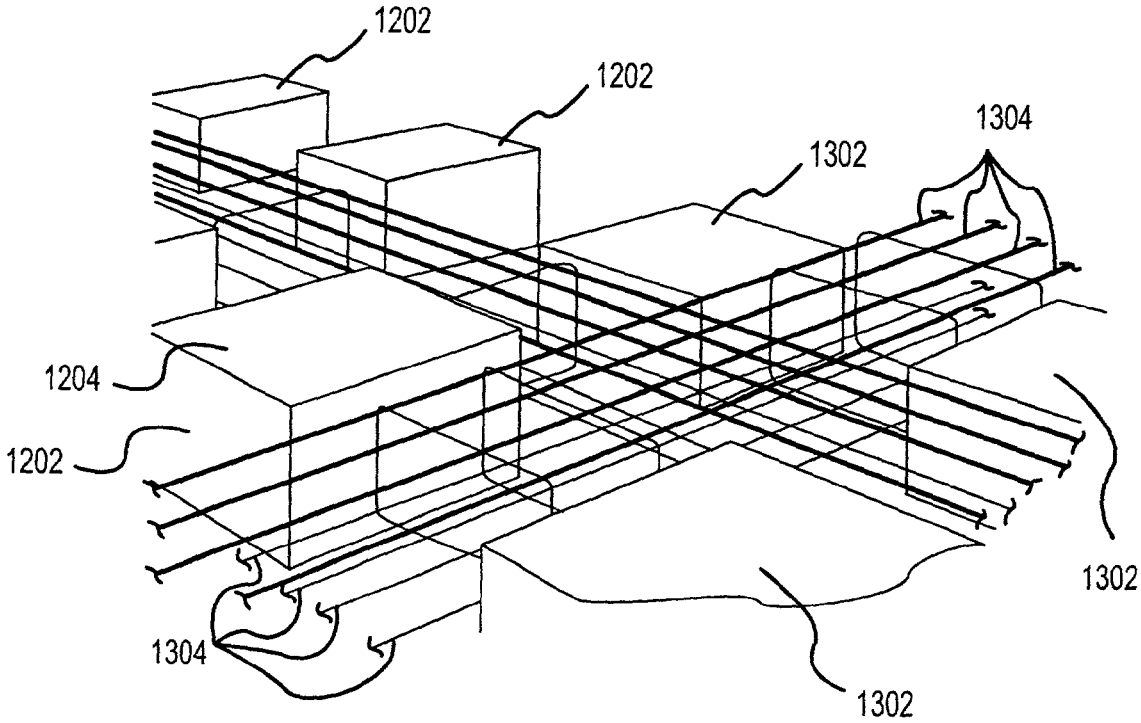
FIG. 13 is a schematic perspective view of a rebar network and a matrix of boxes for use in manufacturing a perforated floor in accordance with one embodiment of the invention.

Referring now to FIG. 13, prior to pouring the perforated floor, a network of rebar 1304 is suitably constructed above the top surface of structural form 1204. As shown, rebar network 1304 is configured to provide appropriate strength and support for the perforated floor, while at the same time leaving the spaces (perforations) defined by structures 1202 uninterrupted. Alternatively, it may be desirable to extend some portion of rebar network 1304 through at least some structures 1202. This would result in some of the perforations in the finished perforated floor having rebar extending therethrough. Although this circumstance should not significantly impede airflow through the openings in a clean room environment, care should be taken to ensure that sufficient room is left within the opening to allow facilities lines to extend through the opening, if desired.

With continued reference to FIG. 13, it can be seen that structures 1202 extend above rebar network 1304. When the perforated floor is poured on top of form 1204, it should be poured to a height less than or equal to the height of boxes 1202. In this way, structures 1202 will define an array of openings which extend completely through the perforated floor. If desired, the height of structures 1202 may be greater than the desired thickness of the perforated floor, to allow workers and equipment to perform any additional tasks on the perforated floor while the concrete is drying (by walking on the tops of structures 1202).

In accordance with one aspect of the present invention, it may be desirable to incorporate one or more structures 1302, which are analogous to structures 1202 but which have a height which is less than structures 1202. In this way, the resulting perforated floor will exhibit a series of openings which extend entirely through the floor corresponding to structures 1202, as well as a series of openings which extend into but not all the way through the finished floor corresponding to structures 1302. The thickness of the concrete (or other floor material) in the region of "perforations" corresponding to structures 1302 is defined by the difference in height between the top surface of structures 1302, on the one hand, and the thickness of the poured floor on the other hand.

Figure 21:
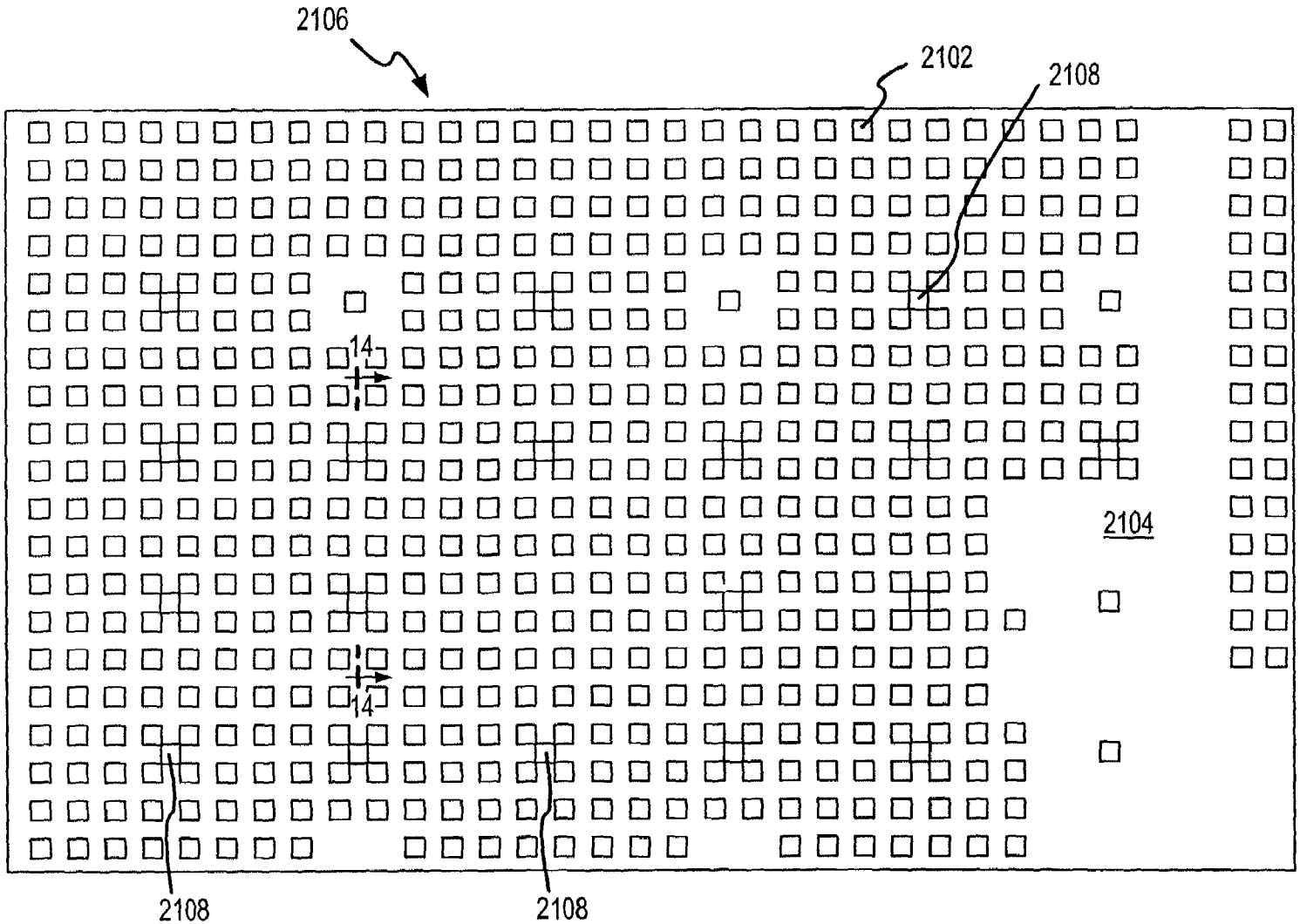
FIG. 21 is a schematic top view layout of an exemplary perforated floor showing relative locations of support columns, perforated openings and covered perforations in accordance with one embodiment of the present invention.

More particularly and with momentary reference to FIG. 21, an exemplary layout 2106 illustrates a perforated floor pattern for a clean room which includes a plurality of openings 2102 as well as one or more regions 2104 exhibited by, for example, a continuous solid planar top surface. In accordance with one aspect of the present invention, the respective openings 2102 correspond to structures 1202 in FIG. 13. Region 2104, on the other hand, corresponds to structures 1302, with the result that the top surface of region 2104 appears to be a uniform concrete slab. However, on the bottom side of region 2104 (not shown), the perforations extend through the bottom of the perforated floor but do not extend all the way through the floor. This may be desirable if, for example, the initial layout 2106 of a clean room facility includes regions 2104 for use as toilet facilities, offices, hallway, or the like. If at a later time it is desired to convert a portion of one or more regions 2104 into clean room space, the relatively thin slab of concrete corresponding to structures 1302 may be removed, resulting in openings which extend all the way through the perforated floor.

With continued reference to FIG. 13, once the concrete floor is poured and dried, structures 1202 (and if desired structures 1302 as well) are removed, resulting in a perforated floor supported by columns 1002. With momentary reference again to FIG. 21, respective column outlines 2108 indicate the orientation of columns 1002 in the context of the array of perforations 2102. In the illustrated embodiment, which includes a rectangular array of equally spaced square perforations 2102, the supporting columns are disposed with perforations at each corner of the column; consequently, the areas of the perforated floor on top of and adjacent to the four sides of each column are characterized by rebar enforced, non-perforated regions of the waffle slab.

In accordance with a further aspect of the invention, for those portions of the perforated floor characterized by a regular rectangular array of rectangular perforations the waffle slab can be thought of as a matrix of a first series of parallel linear rebar enforced concrete strips, and a second series of parallel concrete strips interwoven with and integral with the first series. In the illustrated embodiment, those regions of the perforated floor which include a regular uninterrupted array of openings comprise a two-dimensional area which is 75% solid and 25% open, with the open area being uniformly distributed within the solid area. Depending on the construction materials used, as well as the shape and distribution of the openings, a vibration dampening floor may be constructed in accordance with the present invention which includes on the order of 40%–95% solid area, and preferably on the order of 70%–80%, and most preferably about 75%.

Figure 14:
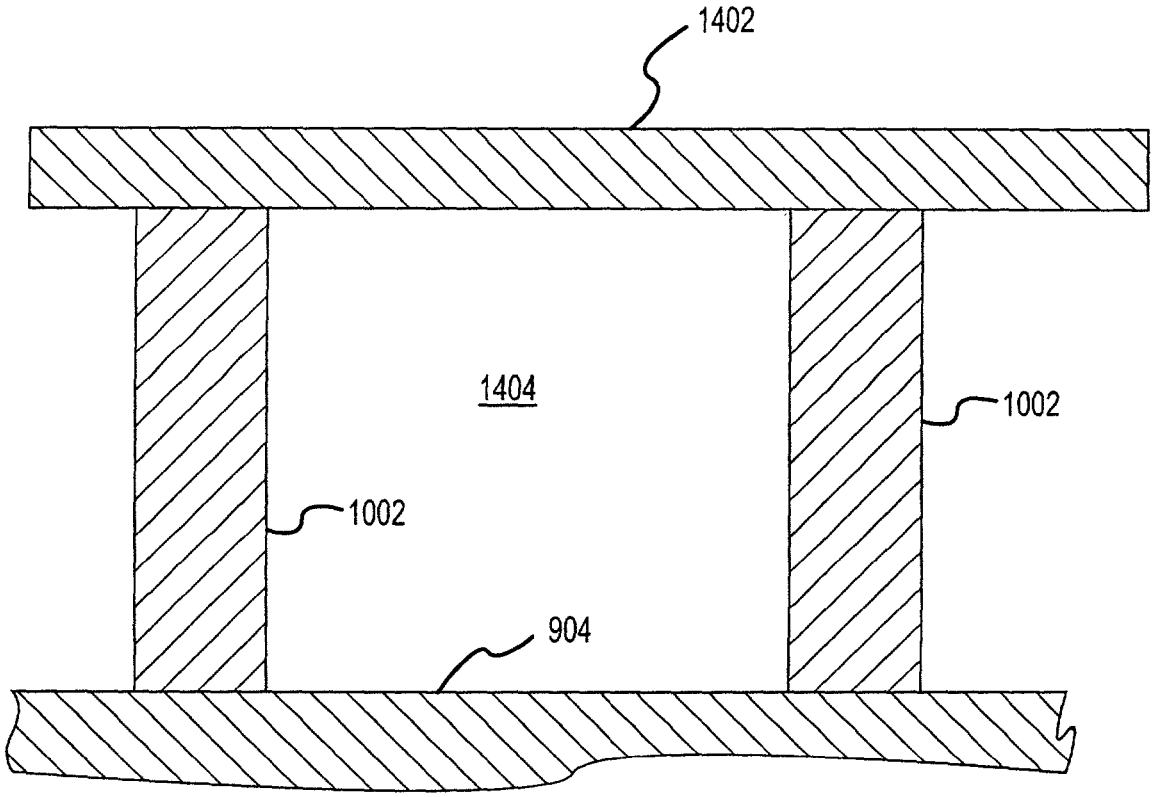
FIG. 14 is a schematic cross-section view of a support structure for a perforated floor in accordance with one embodiment of the present invention.

Referring now to FIG. 14. a cross-section taken along line 14—14 of FIG. 21 illustrates a portion of perforated floor 1402 supported by columns 1002 which extend between the bottom surface of the perforated floor and floor 904 of a facilities room 1404. As discussed above, by ensuring that the top surface of form 1204 is parallel to or slightly lower than the top surface of columns 1002, the perforated floor may be supported directly by columns 1002. As also discussed above, it may be desirable to incorporate beams which extend horizontally between respective columns so that the beams are integral with the perforated floor.

In accordance with a further aspect of the present invention, the square area of a clean room facility may be increased or decreased, as desired, with greatly reduced cost as compared to the expansion of known clean room facilities.

Figure 15:
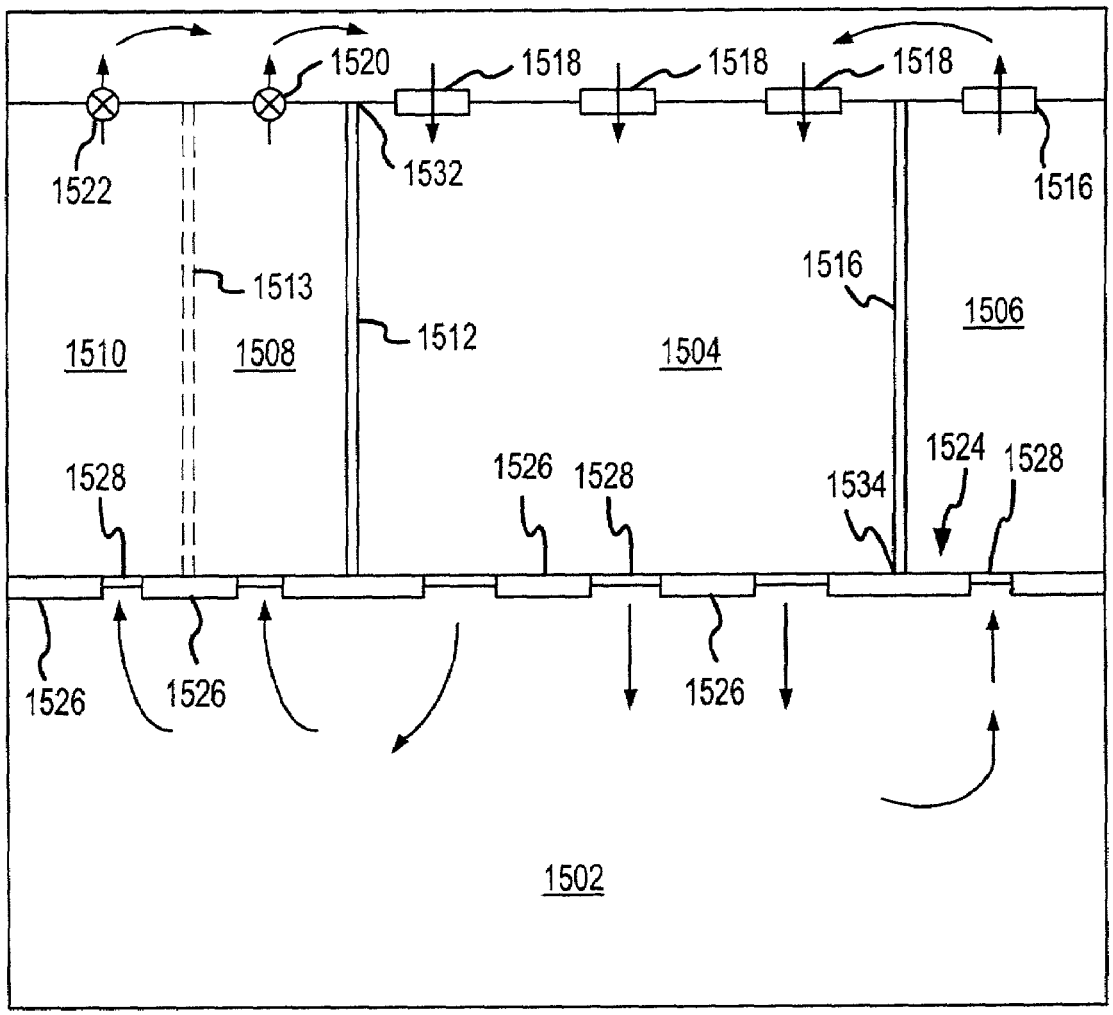
FIG. 15 is a schematic airflow diagram illustrating expansion of the square area of a clean room in accordance with the present invention.

Referring now to FIG. 15, a clean room facility in accordance with one embodiment of the present invention comprises of facilities room 1502, a clean room 1504, and one or more air return plenums, for example a first air plenum 1506 and a second air plenum 1510. The perforated floor includes solid portions 1526 interposed with a plurality of openings 1528. In the example shown in FIG. 15, each of the openings 1528 are equipped with a grate which provides structural support for equipment within clean room 1504, but which also allows the free flow of air therethrough. Alternatively, one or more of the openings may be covered with other inserts, including air-impervious and air-permeable inserts.

Clean room 1504 is bounded by a first wall 1512 and a second wall 1514, each of which are suitably characterized by an airtight seal along the top joint 1532 with the ceiling of the clean room, as well as along the bottom joint 1534 between the walls and the perforated floor. Clean air is forced into clean room 1504, typically through a series of filters 1518 mounted in the clean room ceiling. In one embodiment, the filters 1518 perform the function of removing particles from the air; alternatively, the air cleansing process could take place at any desired point within the airflow circuit, for example within facilities room 1502, within the air plenum, or at any other convenient point. The air which is forced through the clean room passes through the clean room, washing particulates from the clean room environment, whereupon the air and the particulates pass through the openings 1528 on the clean room floor and are urged downwardly into the facilities room. The air is then circulated upwardly through the plenum and returned to filters 1518.

In one embodiment, the air may be drawn upwardly through the plenums and returned to filters 1518 by a series of compressors, fans, or other air circulation apparatus, such as compressors or blowers 1520 and 1522 which are mounted in the ceiling of plenum 1510, as well as compressor 1516 which is shown mounted in the ceiling of plenum 1506.

With continued reference to FIG. 15, the manner in which the area of a clean room may be conveniently expanded will now be described.

As shown, clean room 1504 is bounded by first wall 1512. To increase the area of clean room 1504 in accordance with one aspect of the present invention, wall 1512 could be moved to position 1513, i.e., on top of another solid portion 1526 of the perforated floor. As such, that portion 1508 of return air plenum 1510 is now available for use as additional clean room space. By removing compressor 1520 and replacing it with a filter 1518, clean air is then forced downwardly through 1508 and into facilities room 1502, to be recirculated through air plenum 1510 back into the clean room. Thus, by simply moving a wall and changing the direction of airflow through area 1508, the square area of the clean room may be greatly increased with relatively little cost and effort as compared to existing clean room facilities.

Figure 16:
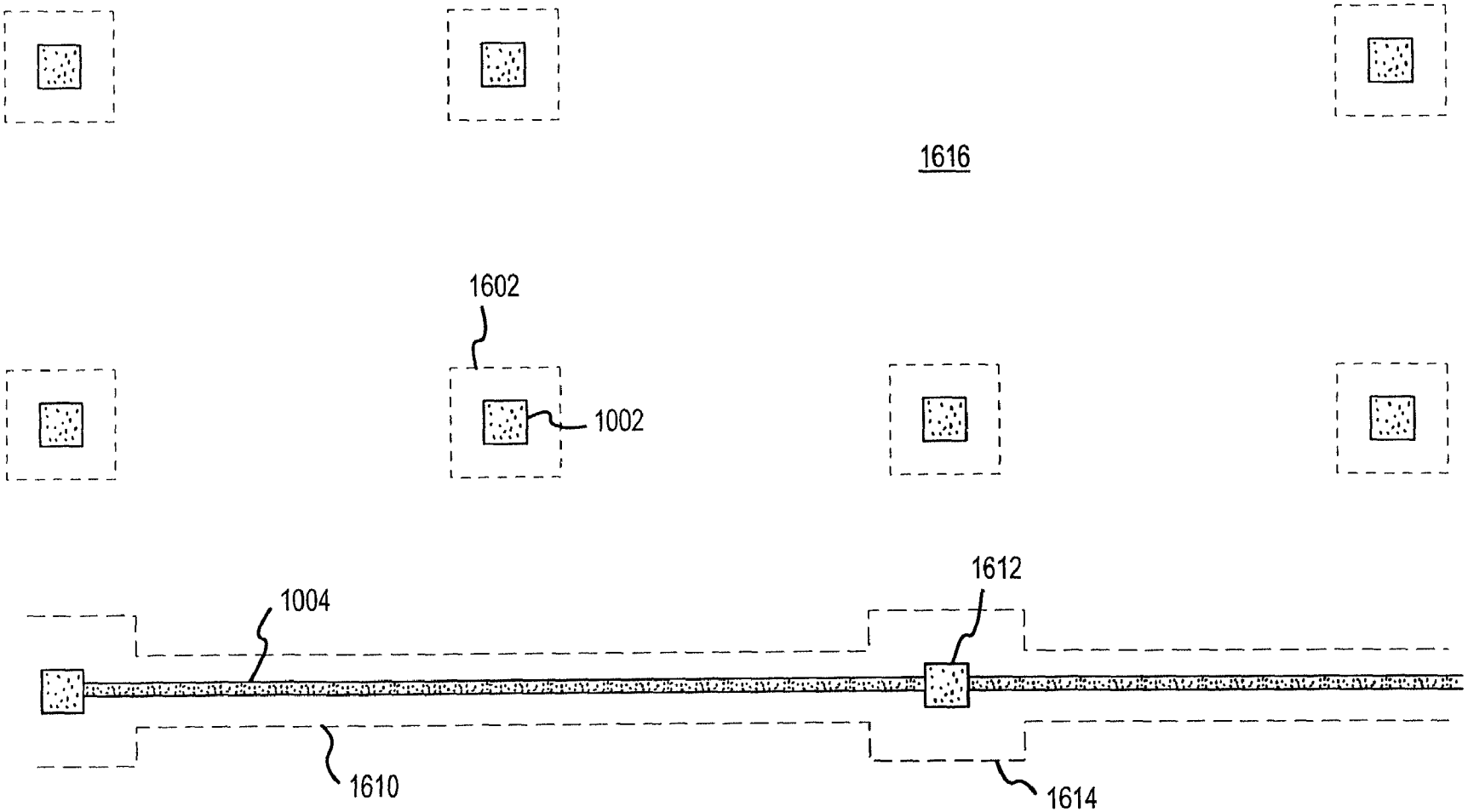
FIG. 16 is a top view layout of a footer plan.

Referring now to FIGS. 9 and 16, an exemplary foundation plan 1616 for the walls and columns which support the perforated floor is shown. Foundation plan 1616 suitably includes a wall footer 1610 for supporting wall 1004, a column footer 1602 for supporting the interior columns 1002, and a column footer 1614 for supporting any columns 1612 which may be incorporated into or as part of the structure of wall 1004. Referring to FIG. 9, the positions of columns 1002 in FIG. 16 correspond to column locations 908 (FIG. 9) in a preferred embodiment.

Figure 17:
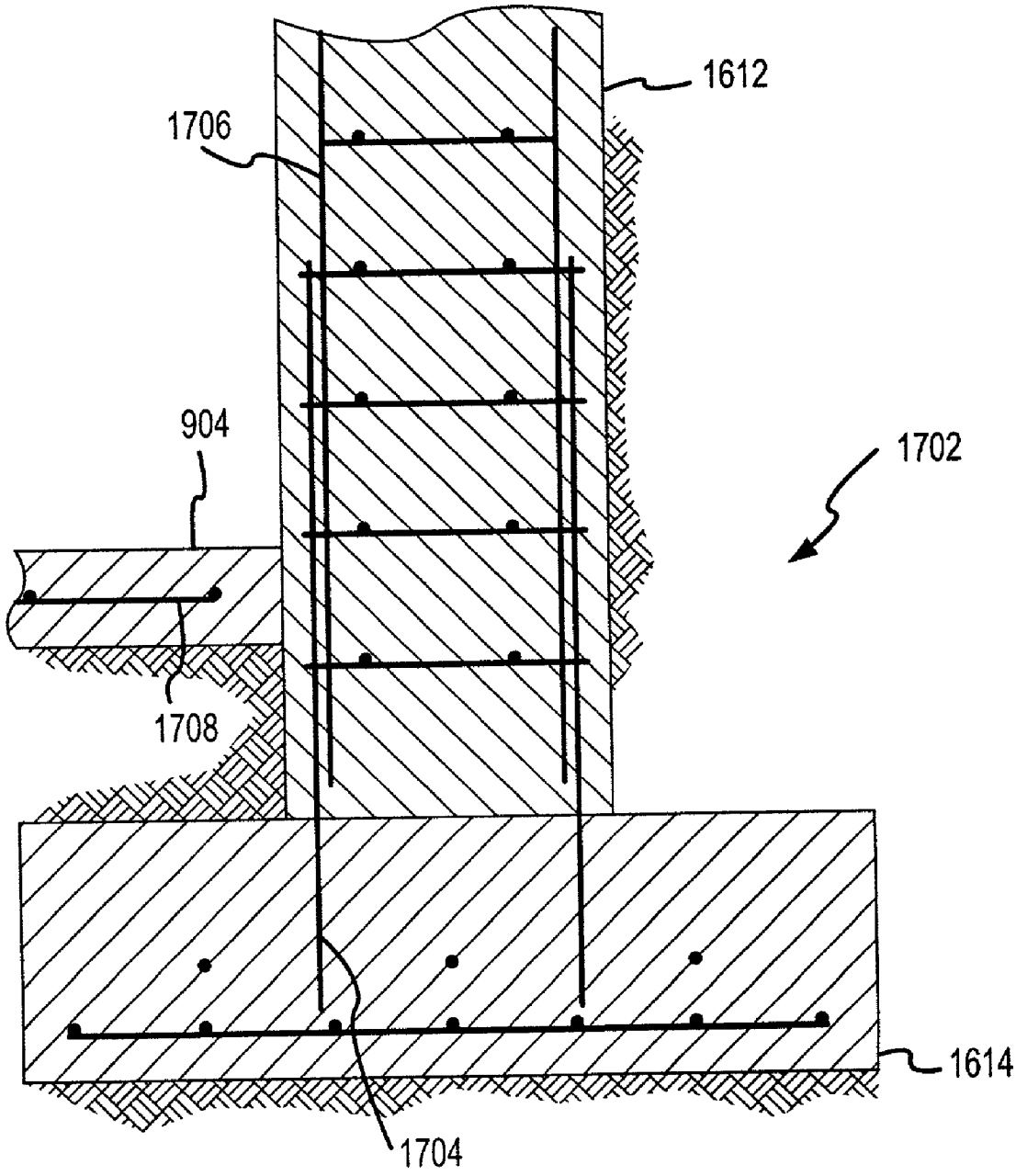
FIG. 17 is a schematic cross-section view of a wall column footer assembly.

Referring now to FIG. 17, a wall column footer assembly 1702 illustrates the structural relationship among wall column footer 1614, wall column 1612, and subfloor 904 (subfloor 904 corresponds to the solid floor of the facilities room described above). In a preferred embodiment, rebar 1704 extends from footer 1614 and into column 1612, where it is secured to rebar 1706 which is integral with and internal to column 1612. Note that in the illustrated embodiment, slab 904 abuts up against column 1612, but is not rebar coupled to the column. In an alternate embodiment, rebar 1708 which is integral with floor 904 may extend into column 1612 and, if desired, may be coupled to rebar within column 1612 to thereby provide rebar coupling between floor 904 and column 1612.

Figure 18:
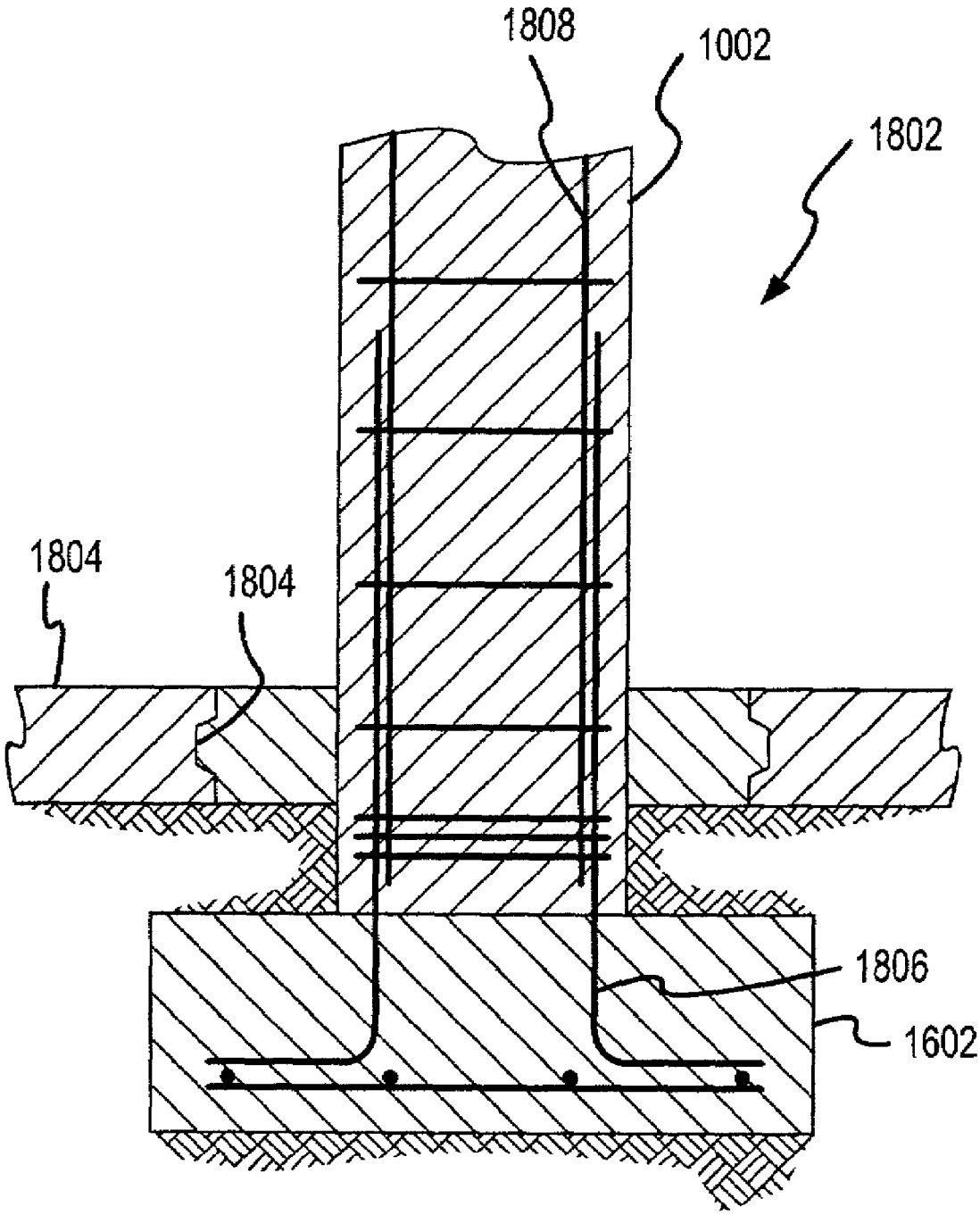
FIG. 18 is a schematic cross-section view of an interior column footer assembly.

Referring now to FIG. 18, an interior column footer assembly 1802 illustrates column 1002 secured to footer 1602. In particular, rebar 1806 which is interior to footer 1602 suitably extends into column 1002 and is rebar coupled with rebar 1808 which is integral with column 1002. In a preferred embodiment, floor 904 is not rebar coupled to interior columns 1002. Alternatively, floor 904 may be rebar coupled to one or more of interior columns 1002. In accordance with a further aspect of the invention, one or more horizontally extending keyway joints 1804 may be incorporated into floor 904, for example in the vicinity of one or more interior columns 1002.

Figure 19:
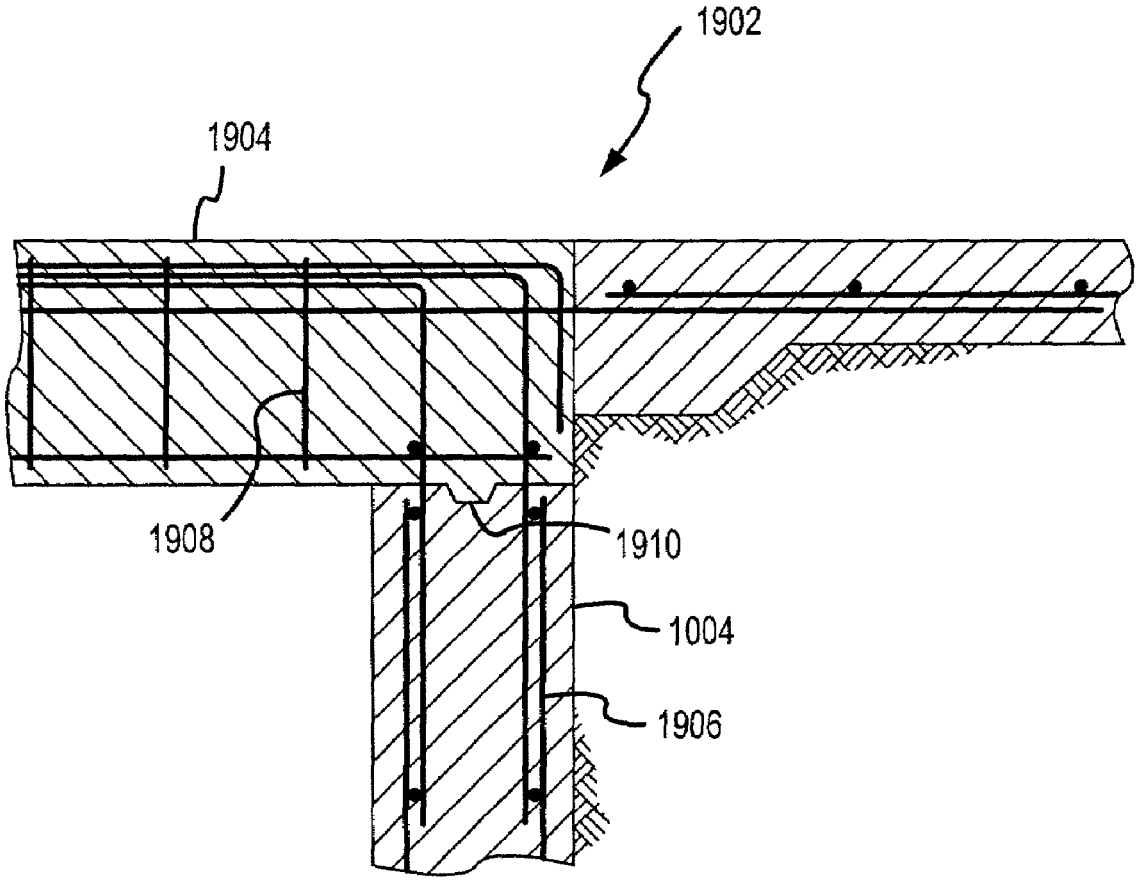
FIG. 19 is a schematic cross-section view of a wall/waffle slab rebar assembly.

Referring now to FIG. 19, a wall coupling assembly 1902 illustrates an exemplary embodiment of a configuration for coupling an edge portion 1904 of the waffle floor to the top of a section of wall 1004. In particular, rebar 1906 which is integral with wall 1004 is suitably coupled to sections of rebar 1908 which is integral with floor portion 1904 but which also extend into wall 1004. In a particularly preferred embodiment, a keyway 1910 may be formed on the top surface of wall 1004 such that section 1904 of the waffle floor conforms to the keyway during formation of the waffle slab.

Figure 20:
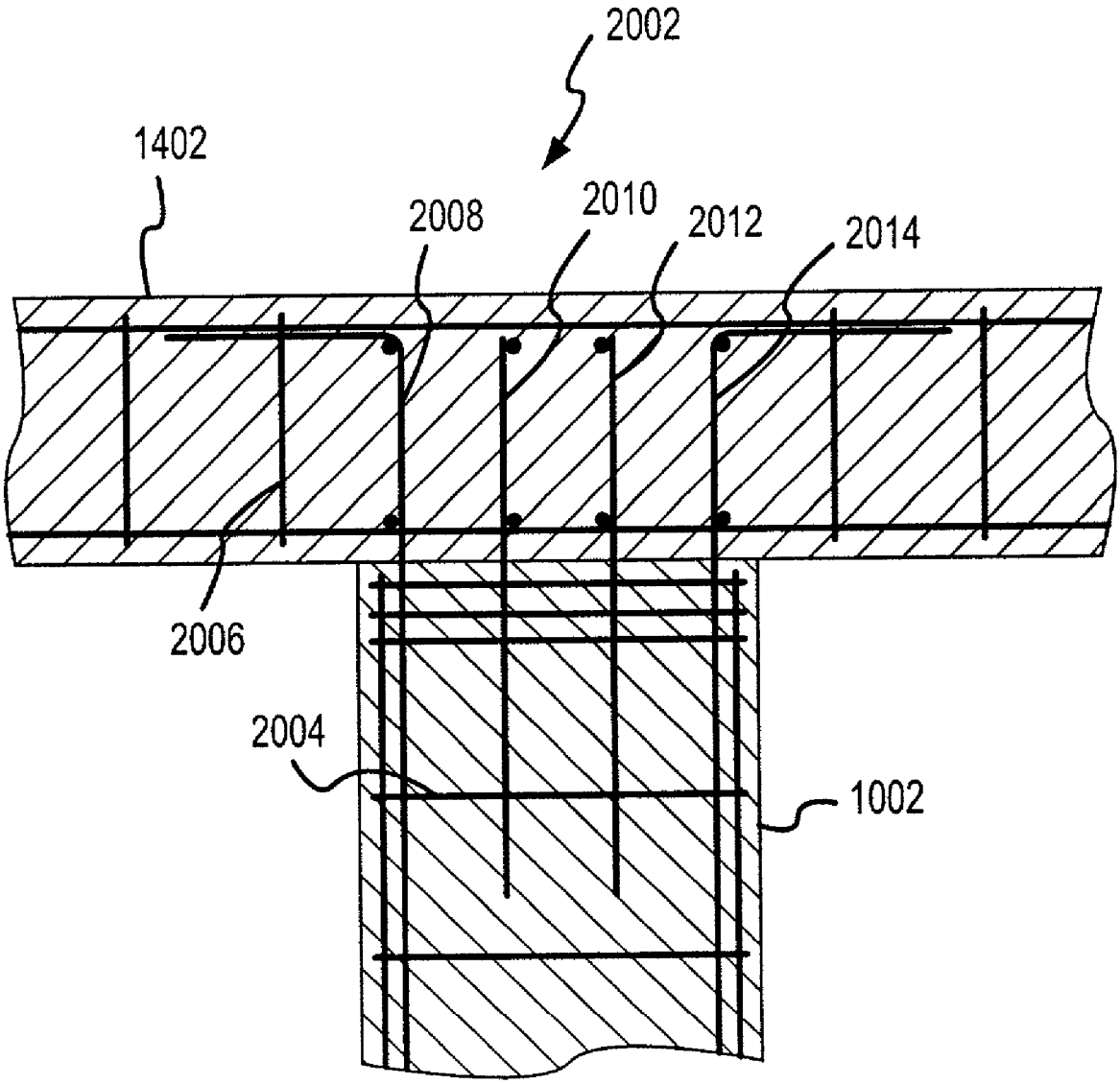
FIG. 20 is a schematic cross-section view of an interior column/waffle slab rebar securing assembly.

Referring now to FIG. 20, a slab floor to column junction assembly 202 illustrates an exemplary rebar coupling of waffle floor 1402 to an exemplary interior column 1002. More particularly, rebar 2004, which is suitably integral with column 1002 extends into and is coupled with rebar 2006 associated with perforated floor 1402. In a particularly preferred embodiment, column rebar 2004 comprises respective segments 2008, 2010, 2012, and 2014. As shown, segment 2008 extends vertically upward through the top of the column, and extends 90° to the left where it is tied to rebar 2006 associated with floor 1402. Segment 2014 extends vertically upward and is bent approximately 90° to the right and tied to floor rebar 2006. Segment 2010 extends orthogonally with respect to segments 2008 and 2014, for example into the plane of the drawing, and segment 2012 suitably extends in a similar manner out of the plane of the page. In this manner, the column rebar may extend perpendicular to each of the 4 sides of the column and couple to the floor rebar in all 4 directions.

The present inventors have determined that constructing a clean room facility in accordance with the foregoing results in a facility having a high degree of vibration isolation and thus renders such a facility highly suitable for semiconductor fabrication and processing applications which involve submicron and even subquarter micron line widths.

More particularly, X and Y axis data were taken on the sides of the interior columns approximately 2 feet below the bottom of the waffle slab. In the preferred embodiment, the columns were spaced 20 feet apart in the x direction and approximately 16 feet apart in the y direction. The z direction is thus perpendicular to the waffle slab floor. The z axis measurements were taken on the clean room floor, midway between columns which is believed to replicate worst case conditions.

The data were collected using an accelerometer available from B&K, type 4379, serial 2047158, and a charge amplifier model ZX2692 also available from B&K. An IOTECH DBK4 Data Acquisition Card with a DBK 2116 acquisition system was used to record the results. The data was sampled at a rate of 2000 samples per second using a high pass filter set at 0.1 hrz and a low pass filter set at 100 hrz. Sensitivity of the accelerometer was set to approximately 316 V/g. During post-processing, the data was stable averaged using a Hanning window (50% overlap) resulting in a frequency band width of 0.25.

In order to compare the observed vibration data with standard published VC Curves, the data was formatted in a one-third octave band spectra having a band width of 23% of each band center frequency, which is a standard data plotting technique when using VC Curves. In all cases, all of the x axis and y axis data were bound by the VC-D Curve, and most of the data was bound by the VC-E Curve. Most of the z axis data was bounded by the VC-B Curve, and much of which was bounded by the VC-C Curve. It is believed that the z axis vibration data can be significantly improved in the context of the present invention through the use of pneumatic isolators on the equipment.

Accordingly, it can be seen that producing a clean room or other facility in accordance with the structures and methods outlined above produce a facility having excellent vibration isolation characteristics.

Thus it is apparent that there has been provided, in accordance with the invention, a clean room facility and a method for its fabrication that overcomes the disadvantages of prior art clean rooms. Although the invention has been described and illustrated with respect to specific illustrative embodiments thereof, it is not intended that the invention be limited to these illustrative embodiments. For example, those of skill in the art will recognize that other building materials and dimensions can be substituted for those set forth in the specific examples given above. For example, the size and spacing of the openings through the floor can be changed to accommodate particular clean room layouts or particular equipment. Likewise, different forms or shapes of the grates can be utilized as would be obvious to those of skill in the art. Accordingly, it is intended to encompass within the invention all variations and modifications as fall within the scope of the appended claims.

What is claimed is:

1. A vibration-inhibiting flooring structure for use in a facility housing vibration-sensitive equipment, comprising:

a bearing floor for supporting the vibration-sensitive equipment;

a plurality of openings extending through said bearing floor, said plurality of openings configured to inhibit the propagation of vibrations across said bearing floor, wherein said plurality of openings comprise a two-dimensional area which is between about 20% and 30% of the total two-dimensional area of said bearing floor which includes said openings.

2. A vibration-inhibiting flooring structure for use in a facility housing vibration-sensitive equipment, comprising:

a bearing floor for supporting the vibration-sensitive equipment;

a plurality of openings extending through said bearing floor, said plurality of openings configured to inhibit the propagation of vibrations across said bearing floor, wherein said plurality of openings comprise a two-dimensional area which is about 25% of the total two-dimensional area of said bearing floor which includes said openings.

3. A vibration-inhibiting flooring structure for use in a facility housing vibration-sensitive equipment, comprising:

a bearing floor for supporting the vibration-sensitive equipment;

a plurality of openings extending through said bearing floor, said plurality of openings configured to inhibit the propagation of vibrations across said bearing floor wherein vibration testing, in accordance with generic vibration criterion (VC) testing, exhibits horizontal vibration amplitudes bounded by the VC-D curve and vertical vibration amplitudes bounded by the VC-B curve.

4. A vibration-inhibiting flooring structure for use in a facility housing vibration-sensitive equipment, comprising:

a bearing floor for supporting the vibration-sensitive equipment;

a plurality of openings extending through said bearing floor, said plurality of openings configured to inhibit the propagation of vibrations across said bearing floor, wherein said plurality of openings form a regular array of openings having a shape selected from a group consisting of rectangular, square, trapezoidal, triangular, circular, and elliptical, and wherein said plurality of openings are arranged sixteen feet apart in an x direction and twenty feet apart in a y direction.

5. The vibration-inhibiting flooring structure of claim 4, wherein the thickness of said bearing floor is about two feet.

6. A reconfigurable, vibration-inhibiting clean room facility capable of supporting vibration-sensitive equipment, said clean room facility comprising:

a perforated floor comprising a plurality of solid regions interposed with a plurality of openings configured in a regular array;

a facilities room located below said perforated floor;

a ceiling located above said perforated floor;

a clean room defined by a plurality of clean room walls moveably attached to said perforated floor and said ceiling, said clean room encompassing a first set of said openings;

a plenum area defined by at least one of said clean room walls and at least one second wall, said plenum area encompassing a second set of said openings disjoint from said first set of said openings;

cleaning apparatus configured to: force air from said clean room to said facilities room through said first set of openings; force air from said facilities room to said plenum area through said second set of openings; and force air into said clean room through said ceiling, wherein said air is cleaned prior to forcing said air into said clean room.

7. The clean room facility of claim 6, further including: one or more filters in said ceiling above said clean room;

one or more blowers in said ceiling above said plenum.

8. The clean room facility of claim 6, further including a plurality of columns supporting said perforated floor.

9. The clean room facility of claim 8, wherein:

said columns include vertical reinforcing bar;

said perforated floor includes horizontal reinforcing bar; and said vertical reinforcing steel bar is secured to said horizontal reinforcing bar.

10. The clean room facility of claim 6, wherein a portion of said openings includes an insert.

11. The clean room facility of claim 10, wherein said insert is air-permeable.

12. The clean room facility of claim 6, wherein a portion of said openings includes a removable air-impervious member.

13. The clean room facility of claim 6, wherein said plurality of openings are arranged in a regular array of openings having a shape selected from a group consisting of rectangular, square, trapezoidal, triangular, circular, and elliptical.

14. The clean room facility of claim 6, wherein at least some of said openings are partially or completely filled with a vibration-inhibiting material.

15. The clean room facility of claim 6, wherein said plurality of openings comprise a two-dimensional area which is between about 5% to 60% of the total two-dimensional area of said perforated floor which includes said openings.

16. The clean room facility of claim 6, wherein said plurality of openings comprise a two-dimensional area which is between about 20% and 30% of the total two-dimensional area of said perforated floor which includes said openings.

17. The clean room facility of claim 6, wherein said plurality of openings comprise a two-dimensional area which is about 25% of the total two-dimensional area of said perforated floor which includes said openings.

18. A method of reconfiguring a vibration-inhibiting clean room facility, said method comprising the steps of:

providing a perforated floor comprising a plurality of solid regions interposed with a plurality of openings configured in a regular array;

providing a facilities room below said perforated floor;

providing a ceiling above said perforated floor;

defining a clean room by moveably attaching a plurality of clean room walls to said perforated floor and said ceiling, wherein said clean room encompasses a first set of said openings;

defining a plenum area adjacent said clean room, wherein said plenum area is defined by at least one of said clean room walls and at least one second wall, wherein said plenum area encompasses a second set of said openings disjoint from said first set of said openings;

providing cleaning apparatus configured to: force air from said clean room to said facilities room through said first set of openings; force air from said facilities room to said plenum area through said second set of openings; and force air into said clean room through said ceiling, wherein said air is cleaned prior to forcing said air into said clean room; and relocating one of said clean room walls such that:

(a) said clean room is expanded to encompass at least one of said second set of openings previously encompassed by said plenum area, or (b) said plenum area is expanded to encompass at least on of said first set of openings previously encompassed by said clean room.

19. The method of claim 18, further including the steps of:

providing, prior to said relocating step, one or more removable filters in said ceiling above said clean room;

providing, prior to said relocating step, one or more removable blowers in said ceiling above said plenum;

moving, after said relocating step, said filters and said blowers such that said filters are located over said clean room and said blowers are located over said plenum.

* * * * *